US007334558B2

(12) United States Patent
Higgins

(10) Patent No.: US 7,334,558 B2
(45) Date of Patent: Feb. 26, 2008

(54) SLIDE BODY INTERNAL COMBUSTION ENGINE

(76) Inventor: Darrell Grayson Higgins, 4884 Denise Dr., Trinity, NC (US) 27370

( * ) Notice: Subject to any disclaimer, the term of this patent is extended or adjusted under 35 U.S.C. 154(b) by 0 days.

(21) Appl. No.: 10/587,954

(22) PCT Filed: Dec. 28, 2004

(86) PCT No.: PCT/US2004/043938

§ 371 (c)(1),
(2), (4) Date: Aug. 1, 2006

(87) PCT Pub. No.: WO2005/067508

PCT Pub. Date: Jul. 28, 2005

(65) Prior Publication Data

US 2007/0034175 A1 Feb. 15, 2007

(51) Int. Cl.
*F02B 75/32* (2006.01)

(52) U.S. Cl. ..... 123/197.4; 123/190.14; 123/55.7

(58) Field of Classification Search ..... 123/55.2, 123/55.7, 197.4, 190.14, 80 D, 81 D
See application file for complete search history.

(56) References Cited

U.S. PATENT DOCUMENTS 688,349 A 12/1901 Scott et al.
1,579,083 A * 3/1926 Collins ..... 74/52
1,647,425 A 11/1927 Wise
1,698,920 A 1/1929 Mohatt
1,909,729 A 5/1933 Southwick
2,170,099 A 8/1939 Stubings
2,310,733 A 2/1943 Duke
2,370,902 A 3/1945 Workman
2,387,143 A * 10/1945 Gernandt et al. ..... 123/80 DA
2,498,846 A * 2/1950 Ball ..... 123/41.16
3,200,800 A * 8/1965 Du Bois ..... 123/53.4
3,895,620 A 7/1975 Foster
4,128,083 A 12/1978 Bock
4,237,741 A * 12/1980 Huf et al. ..... 74/52
4,381,903 A 5/1983 Atkins
4,395,977 A * 8/1983 Pahis ..... 123/197.4
4,413,705 A 11/1983 Inaga et al.
4,459,945 A * 7/1984 Chatfield ..... 123/55.3
4,480,599 A 11/1984 Allais
4,485,768 A * 12/1984 Heniges ..... 123/48 B
4,532,431 A 7/1985 Iliev et al.
4,555,903 A 12/1985 Heaton
4,685,342 A * 8/1987 Brackett ..... 74/50
4,821,692 A * 4/1989 Browne ..... 123/190.2
4,850,313 A * 7/1989 Gibbons ..... 123/54.2
5,002,020 A * 3/1991 Kos ..... 123/46 E
5,076,219 A * 12/1991 Pellerin ..... 123/59.1

(Continued)

*Primary Examiner*—Hai Huynh
(74) *Attorney, Agent, or Firm*—Robert W. Pitts

(57) ABSTRACT

An internal combustion engine includes a slide body having a plurality of rigidly mounted pistons on opposite ends of the slide body. The slide body reciprocates and is connected to a flywheel by shaft and bearing which extends through an angled track in the slide body. As the pistons impart linear movement to the slide body, the flywheel and a drive shaft rotate. Both the slide body and the flywheel are mounted on the interior of the engine. Magnets on the flywheel rotate relative to stationary coil conductors to induce a current. The housing includes four panels, which can be easily assembled and disassembled, which form a housing compartment in which the linearly movable slide piston subassembly and the rotating flywheel are positioned.

21 Claims, 17 Drawing Sheets

U.S. PATENT DOCUMENTS 5,228,416 A 7/1993 Puzio
5,402,755 A * 4/1995 Waissi ..... 123/55.3
5,417,309 A * 5/1995 Brackett ..... 184/6.5
5,448,972 A * 9/1995 Paut ..... 123/62
5,503,038 A * 4/1996 Aquino et al. ..... 74/49
5,727,513 A * 3/1998 Fischer ..... 123/197.4
5,782,213 A * 7/1998 Pedersen ..... 123/55.2
5,884,590 A * 3/1999 Minculescu ..... 123/71 R
5,983,845 A * 11/1999 Yanagisawa ..... 123/53.1
5,988,133 A * 11/1999 Agapiades et al. .... 123/190.14
5,992,356 A 11/1999 Howell-Smith
6,073,595 A 6/2000 Brogdon
6,082,314 A * 7/2000 Li et al. ..... 123/55.4
6,098,477 A * 8/2000 Takachi et al. ..... 74/52
6,167,339 A 12/2000 Pels
6,183,388 B1 * 2/2001 Hawkins ..... 475/336
6,213,064 B1 * 4/2001 Geung ..... 123/54.1
6,279,519 B1 8/2001 Nagel et al.
6,481,406 B2 11/2002 Pels
6,483,197 B1 11/2002 Masberg et al.
6,532,916 B2 3/2003 Kerrebrock
6,742,482 B2 * 6/2004 Artola ..... 123/71 R
7,104,227 B2 * 9/2006 Roberts ..... 123/55.7
7,124,719 B2 * 10/2006 Ariyakunakorn ..... 123/80 D
7,188,598 B2 * 3/2007 Sič et al. ..... 123/197.4
7,210,446 B2 * 5/2007 Sic et al. ..... 123/197.4
2002/0020381 A1 2/2002 Pels
2003/0089321 A1 5/2003 Penzel et al.
2004/0255879 A1 * 12/2004 Zaytsev ..... 123/55.2
2004/0255880 A1 * 12/2004 Kim et al. ..... 123/55.5
2006/0130782 A1 * 6/2006 Boland ..... 123/55.2
2007/0068468 A1 * 3/2007 Irick et al. ..... 123/55.5

* cited by examiner

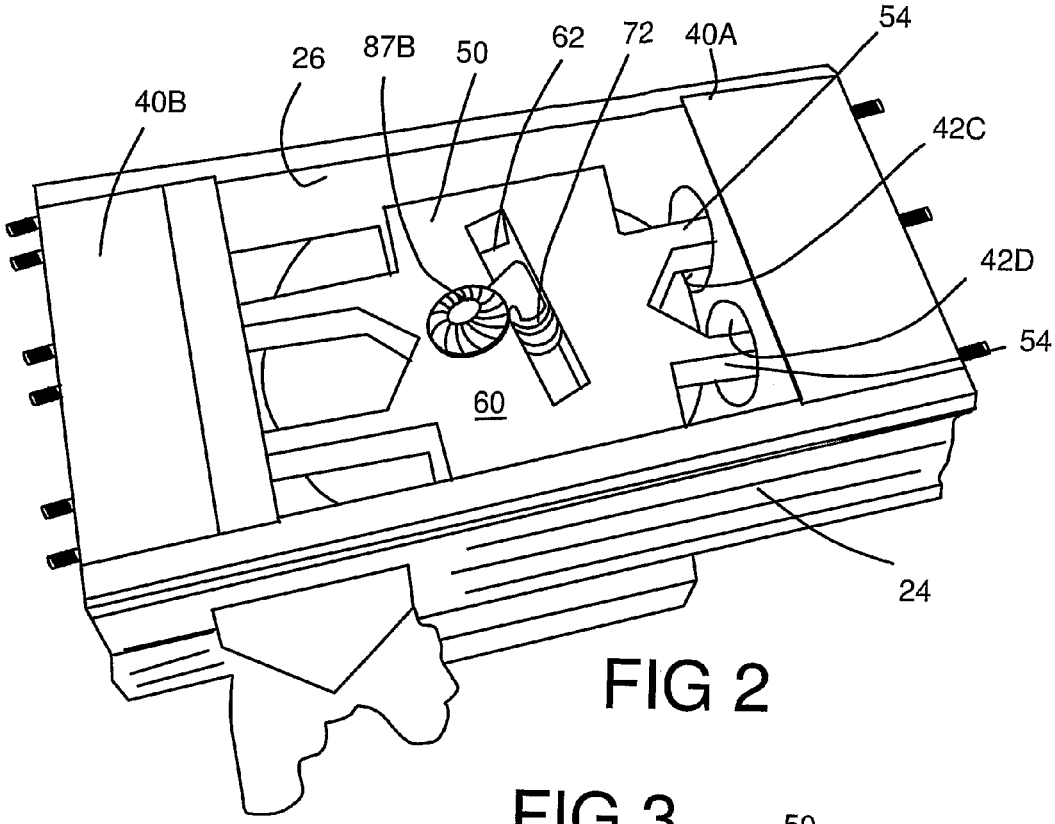
FIG 2
FIG 3
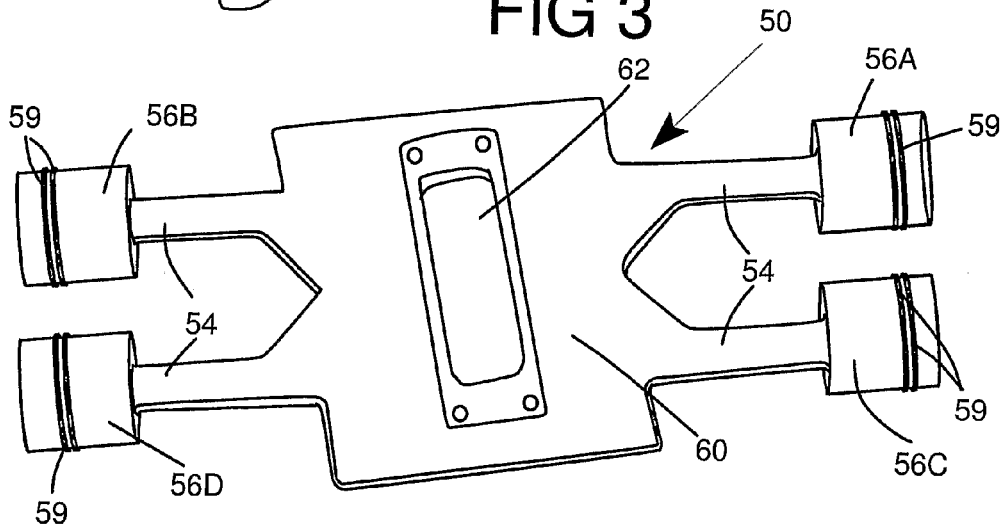

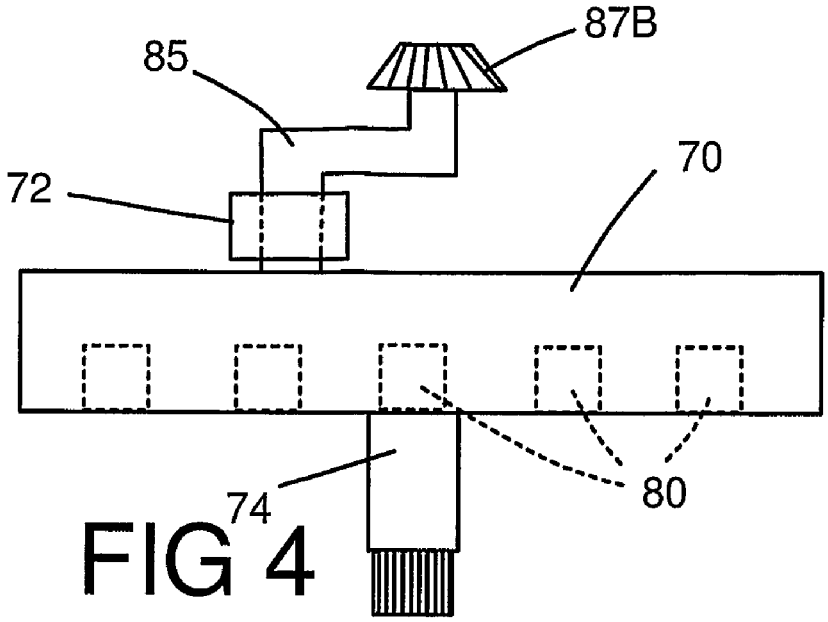
FIG 4
FIG 5
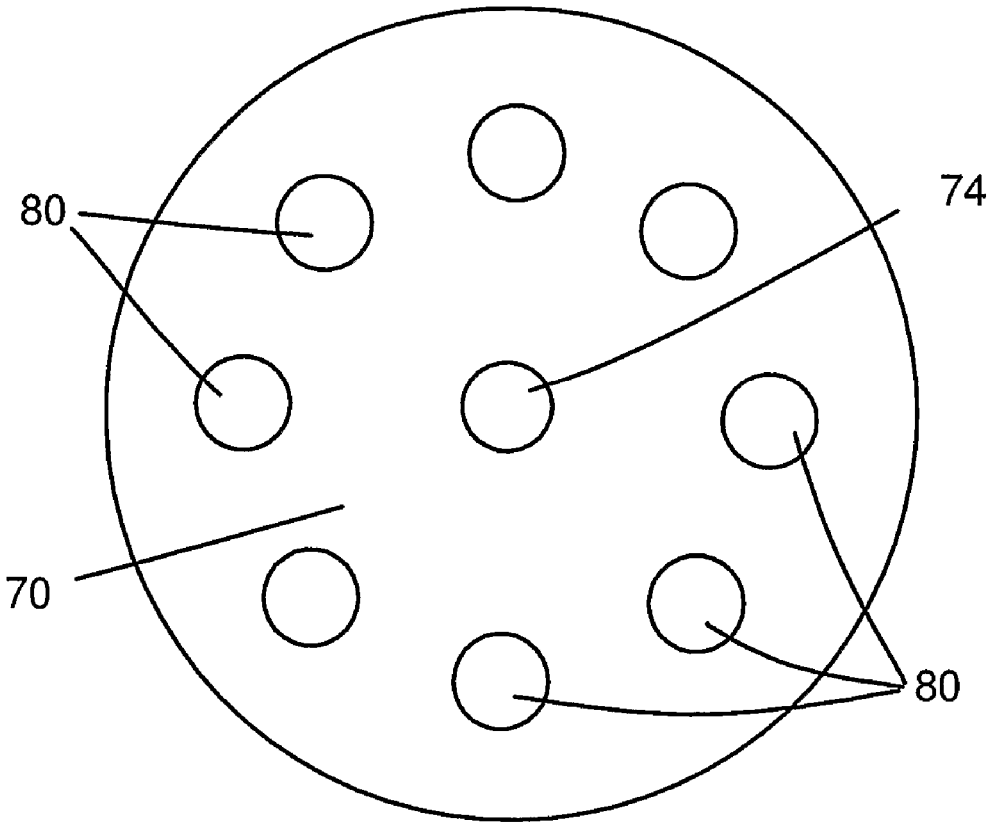

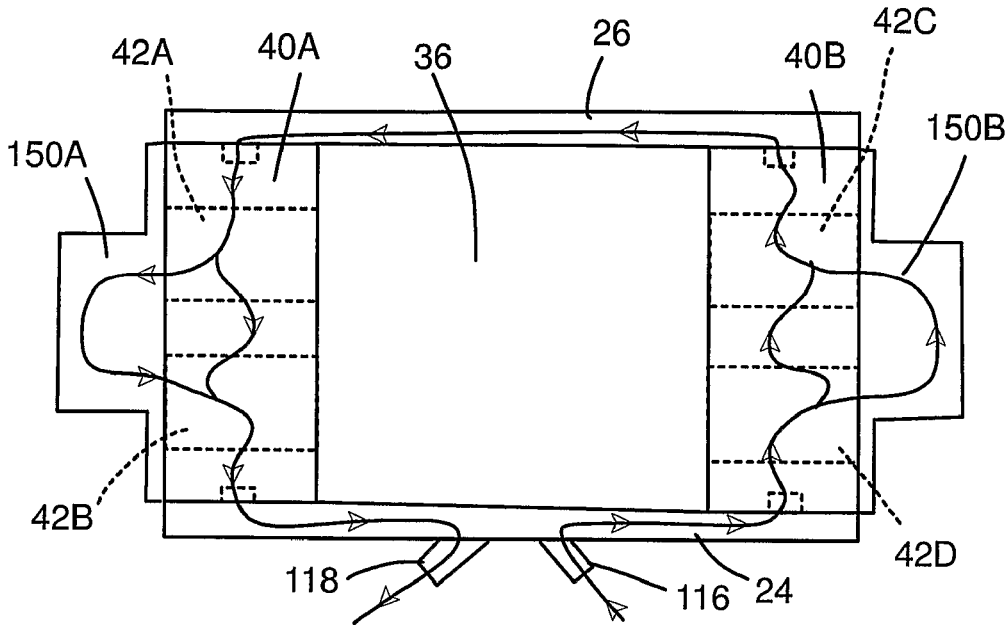
FIG 28
FIG 33
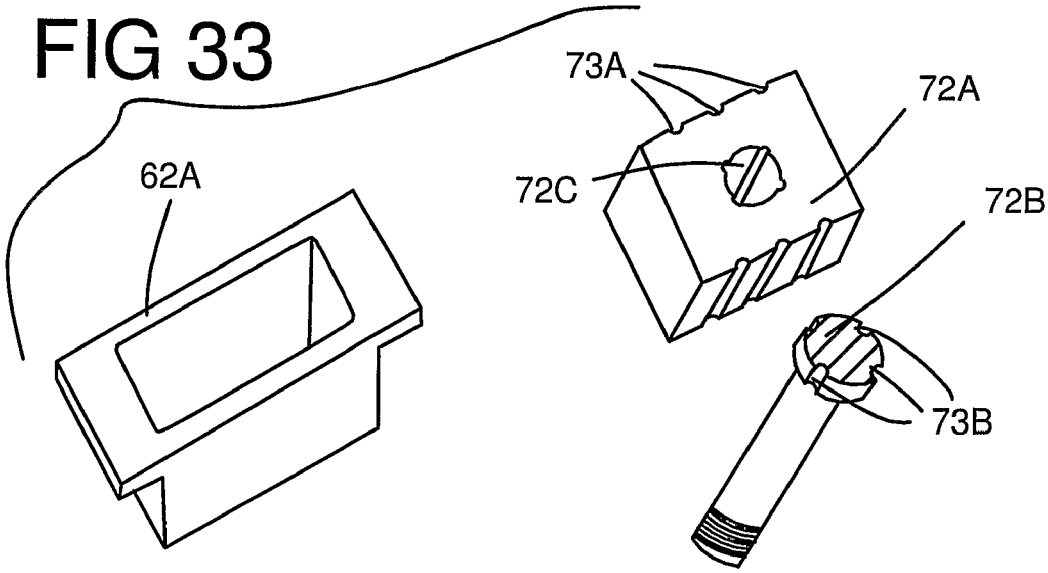

SLIDE BODY INTERNAL COMBUSTION ENGINE

BACKGROUND OF THE INVENTION

This invention relates to internal combustion engines, especially to internal combustion engines that can be used in mobile vehicles, including, but not limited to, automobiles, aircraft and boats. This invention also relates to internal combustion engines in which multiple pistons are joined as part of a rigid subassembly.

A four cylinder horizontally opposed "Flat Four" or "Boxer" engine includes four cylinders, which are mounted horizontally in opposed pairs. The term "Boxer Engine" describes the motion of the four pistons as they move back and forth in opposing pairs, much like a boxer's arms. This engine was first introduced in the late 1930's. The horizontally opposed layout of the cylinders helped to balance out the forces exerted on the crankshaft by the moving pistons and the connecting rods, which connected each individual piston to a centrally mounted crankshaft. Although pistons were located on opposite sides of a central crankshaft, opposed pistons did not move along the same axis, and the four pistons moved along four parallel axes, which intersect the crankshaft at different lateral positions. Unlike the present invention, each of the pistons comprised a separate member with its own connecting rod, which moves angularly relative to both the crankshaft and the piston.

U.S. Pat. No. 6,082,314 discloses another type of opposed cylinder internal combustion engine. In this patent four cylinders are arranged in an H-shaped configuration. Two double acting or double-ended pistons, each with generally cylindrically shaped crowns on opposite sides of flat rectangular parallelepiped middle sections, are mounted on a crank shaft so that each double acting piston reciprocates in opposed cylinders. The two double acting pistons, each of which is part of a one-piece member with piston crowns at either end, move in the same direction during each stroke, and circular slide blocks, eccentrically mounted on the crank shaft, are received in openings between the piston crowns to replace connecting rods. A dynamic balance slide piece reciprocates along an axis perpendicular to the piston reciprocation. The SYTEC engine proposed by CMC Research House at the Department of Mechanical & Manufacturing Engineering of the University of Melbourne also includes a bearing block that moves perpendicular to the motion of two double-ended, single piece pistons connected to a central crankshaft.

U.S. Pat. No. 2,370,902 also discloses multiple sets of double-ended pistons that move in the same direction during each stroke. In this case, connecting rods rigidly connected to pistons at opposite ends are themselves interconnected by a cross bar. Anti-friction rollers mounted on a slide bar secured to the cross bar move with the double ended pistons and engage cams in the form of star shaped plates to impart rotation to a drive shaft.

In U.S. Pat. No. 4,011,842, a pair of spaced parallel, double-ended cylinders straddle a crankshaft and two double-ended pistons are connected to the crankshaft by a T-shaped connecting member so that linear motion of the double-ended pistons causes rotation of the crankshaft. The two doubled-ended pistons move in opposite directions. U.S. Pat. No. 6,446,587 and U.S. Pat. No. 6,073,595 are other examples of internal combustion engines with double-ended pistons moving in opposite directions.

It has been suggested that internal combustion engines with double-ended pistons can also be used to produce an electrical current. In U.S. Pat. No. 6,532,916 an oscillating alternator coil attached to a moving double-ended piston in an internal combustion engine moves through a magnetic field imparted by a stationary magnet. In some small internal combustion engines and alternator often comprises a ring of magnets mounted on a rotating flywheel, which act in conjunction with stationary core and windings on the engine body. Two examples of such devices are shown in U.S. Pat. No. 3,828,212 and U.S. Pat. No. 4,101,371.

The instant invention is believed to include many of the advantageous features represented by these examples of the prior art, but achieves these improvements by employing a configuration in which the components are easier to fabricate and in which assembly is simpler. The instant invention should therefore be easier to service since assembly and disassembly are more straightforward. The anticipated life and reliability of the engine constructed according to this invention should also be significantly greater than has heretofore been possible with more elaborate engine configurations. Relative movement of component parts of this engine is believed to place less stress on moving parts, and these moving parts can be lubricated more efficiently and more effectively. The efficiency that can be achieved with this inventive configuration is also believed to be superior to that which can be achieved with conventional internal combustion engine configurations. In view of the simplicity of the basic operation of this engine, excessive vibration should not be a problem. In spite of the effort that has been expended to improve the performance of conventional internal combustion engine configurations, the piston slide body configuration of the instant invention should offer these and other advantages over these and other prior art configurations.

SUMMARY OF THE INVENTION

According to one aspect of this invention, an internal combustion engine can include the following components. A housing encloses a compartment with opposed cylinders at opposite ends of the compartment for receiving pistons. The pistons are on a slide body reciprocal in the housing compartment. The slide body has pistons at opposite ends of the slide body. Individual pistons are received within individual cylinders. Cyclical combustion within the cylinders imparts linear reciprocal motion to the slide body. A rotating disk, which can be a flywheel, is positioned in the housing compartment. The rotating disk is located adjacent to the slide body and is rotatable about an axis generally perpendicular to linear reciprocal movement of the slide body. Interengaging members on the slide body and rotating disk sufficiently laterally offset from the axis of rotation of the rotating disk impart rotary motion to the rotating disk as the slide body linearly reciprocates within the housing compartment. The assembly also includes a drive shaft extending through the housing. Rotation of the rotating disk is transmitted to the drive shaft so that linear motion of the slide piston is transmitted through the rotating disk to the drive shaft for delivering external power.

According to another aspect of this invention an internal combustion engine includes the following. Reciprocal pistons engage a rotary member to transfer linear motion of the pistons to rotary motion, the pistons being mounted in a housing including the following housing components. The engine includes an upper cover and a separate lower cover. Side plates are attachable to and detachable from the upper cover and the lower cover adjacent opposite edges thereof to form a central housing subassembly having a generally rectangular cross section. A cylinder body can be attached to and detachable from one end of the central housing subassembly, the cylinder body including cylinders receiving the reciprocal pistons. A head and valve subassembly is attachable to and detachable from the cylinder body and encloses one end of the cylinders. This internal combustion engine can be assembled and disassembled by respectively attaching and detaching the housing components in surrounding relationship to the reciprocal pistons and the rotary member.

According to still another aspect of this invention, a piston subassembly for use in an internal combustion engine includes a central body including at least one arm extending from each end of the central body. The piston subassembly also includes cylindrical pistons on the distal ends of each arm, the central body, the arms and the cylindrical pistons comprising a rigid body such that as the piston subassembly moves through a complete cycle, and no relative angular movement of the cylindrical pistons, the arms and the central body occurs. The piston subassembly also includes an engagement surface on the central body, which engages a separate member during linear movement of the piston subassembly to impart rotary movement to the separate member to output energy due to combustion in the internal combustion engine.

According to a fourth aspect of this invention, an internal combustion engine includes an electrical generator, which comprises a flywheel located within a nonferromagnetic engine housing. The flywheel has a number of magnets attached thereto to increase the inertia of the flywheel and a plurality of electrical conductors located on the exterior of the nonferromagnetic engine housing. Rotation of the flywheel relative to the electrical conductors generates an electrical current in the electrical conductors.

According to another aspect of this invention, an internal combustion engine includes a plurality of linearly reciprocal pistons, all of the pistons moving in the same direction during each stroke. The internal combustion engine also includes a flywheel having an axis of rotation substantially perpendicular to the direction in which the pistons move. The flywheel has sufficient angular momentum to dampen reaction forces acting in a direction opposite from the direction of movement of the pistons during sequential strokes due to the expansion of a combustible fuel-air mixture sequentially acting on individual pistons so that the internal combustion engine can be employed in a mobile vehicle, such as an automobile or other motor vehicle, and airplane, a lawnmower, off the road vehicles, and in many other applications.

A linear gear bearing can also be used to prevent any bureau drawer effect as the slide body piston reciprocates.

BRIEF DESCRIPTION OF THE DRAWINGS

FIG. 2 is a view of a subassembly of the engine shown in FIG. 1, looking into an internal compartment, which contains a slide body piston and a flywheel mounted between two engine side plate and two cylinder bodies.

FIG. 3 is a view of the slide body piston shown in FIG. 2 with four pistons, with a pair of pistons extending from a central body.

FIG. 4 is a side view of the flywheel shown in FIG. 2, with a bearing, crank arm and gear extending above the flywheel and with a drive shaft extending below.

FIG. 5 is a bottom view of the flywheel of FIG. 4 showing a number of magnets positioned symmetrically around the flywheel.

FIG. 28 is a view of coolant flow path through the side plates, the cylinder bodies and the heads.

FIG. 33 is a view of the components of an improved slide bearing assembly, including the track, which is attached in the slot in the central portion of the slide body.

DETAILED DESCRIPTION OF THE PREFERRED EMBODIMENTS

Figure 1:
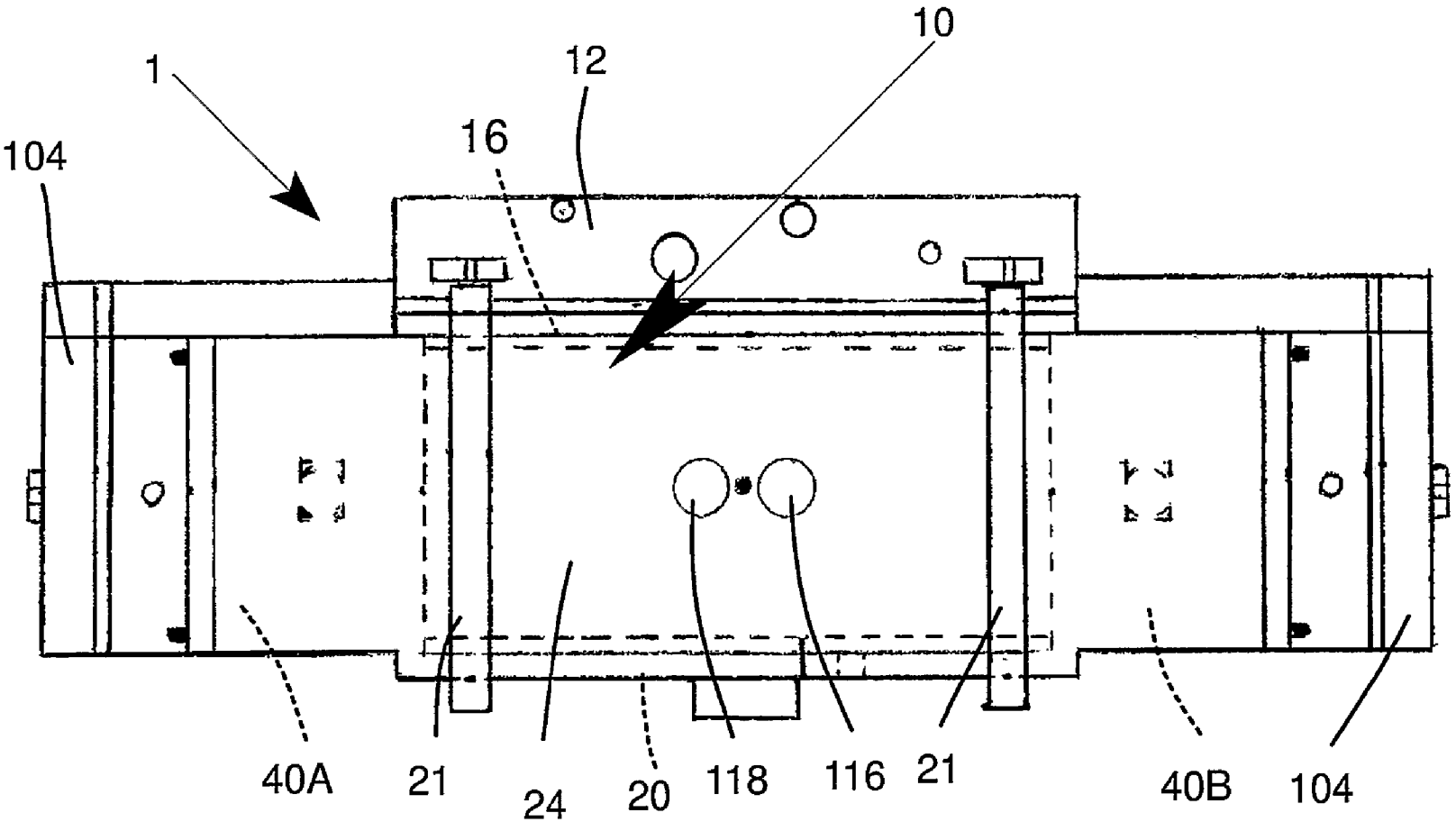
FIG. 1 is a side view of the preferred embodiment of the slide body internal combustion engine according to this invention.

Although not limited to a four stroke, two cycle internal combustion cycle, this invention will be described in terms of this representative configuration. It should be understood that the basic invention can be adapted to other internal combustion cycles by one of ordinary skill in the art and that this invention can be implemented as different configurations, which would be apparent to one of ordinary skill in the art. Some aspects of this invention are also suitable for use with apparatus other than an internal combustion engine.

The preferred embodiment of the internal combustion engine 1 according to this invention has two primary internal moving parts located within a housing to deliver the power generated by the combustion of an air fuel mixture. These internal moving parts are a slide body 50, which reciprocates in a straight line, and a rotating disk, which preferably is in the form of a flywheel 70. Both the slide body 50 and the rotating disk or flywheel 70, are located within the same compartment 36 formed by a main housing 10. The slide body 50 includes a plurality of pistons 56A-D and the rotating disk or flywheel 70 is connected to an external drive shaft 74. In the preferred embodiment, linear movement of the slide body 50 is transmitted to the flywheel 70 by engagement of a slide bearing or pin 72 located on the flywheel 70 with a track 62 located on the slide body 50.

Valves 92 and means for operating the valves are located in a valve-cam subassembly located at the ends of the main housing 10. In the preferred embodiment an external valve shaft 100 is rotated in response to linear movement of the slide body 50. The engine 1 can be carbureted or fuel injected. The engine 1 is cooled by an external electric water pump, which moves coolants throughout the engine 1. External mechanical oil and water pumps can also be used.

The basic operation of a two stoke, four cycle engine in accordance with this invention can be understood with reference to FIGS. 2-5 and FIGS. 23 and 24. Starting with the slide body 50 and pistons in the position shown in FIG. 23, piston 56B in cylinder 40B will be fired causing the slide body 50 and attached pistons to move to the right from the position shown in FIG. 23 to the position shown in FIG. 24. During this movement, a fuel-air mixture in cylinder 42A is compressed, while a fuel air mixture is drawn in by simultaneous movement of piston 56D in the corresponding cylinder. Piston 56C expels the spent combustion products in that cylinder. When the slide body reaches the position shown in FIG. 24, the compressed fuel air mixture in cylinder 42A is ignited by a spark, causing the slide body to move back to the left to the position shown in FIG. 23. Compression, expansion, injection and expulsion then occur sequentially in each cylinder in the same fashion as in a conventional two stroke, four cycle engine.

The main housing 10 includes four main interlocked walls or parts 16, 20, 24, 26 that can be fitted together with a minimum number of fasteners to simplify assembly and disassembly of the engine 1. One advantage of this engine is that the need for a majority of the head gaskets in conventional engines is eliminated and mating parts of this engine can be sealed with liquid sealants, such as silicone These four interlocked parts 16, 20, 24, 26 surround the main housing compartment 36 in which the slide body 50 and the flywheel 70 are located. Two cylinder bodies 40A and 40B are located at opposite ends of the main compartment 36. A plurality of side by side cylinders 42A-D communicate with the main housing compartment 36. These cylinders 42A-D extend through the cylinder bodies 40A and 40B, to the heads 90A and 90B, in which intake and outlet ports 113A and 113B for each cylinder are located, close the ends of the cylinders 42A-D. The mechanisms for opening and closing the valves are also located on these valve-cam plates 98. In the preferred embodiment, valve-cam gears 94 driven by the external valve shaft 100 are located on the valve plates 98.

In the preferred embodiment, multiple pistons are located on each end of the slide body. These pistons are rigidly connected as part of the slide body, and the pistons reciprocate within the cylinders without side forces between the pistons and the cylinders, thus causing only even, circular wear on the cylinders. The slide body includes a central body, which reciprocates along a tongue and grooved or bearing tract relative to the housing side plates to insure that the slide body moves linearly without any significant angular movement. The housing 10 and other components will be discussed in greater detail after a more thorough description of the primary moving parts that translate the combustion of a fuel air mixture into usable external power.

Combustion of fuel-air mixture in the cylinders 42A-D causes expansion of the gas and forces the pistons 56A-D outward during this expansion stroke. The preferred embodiment is intended for use in a standard four cycle, two stroke engine, although the basic invention can be employed for two stroke engines, for Diesel engines or for other conventional internal combustion engine cycles.

Figure 9:
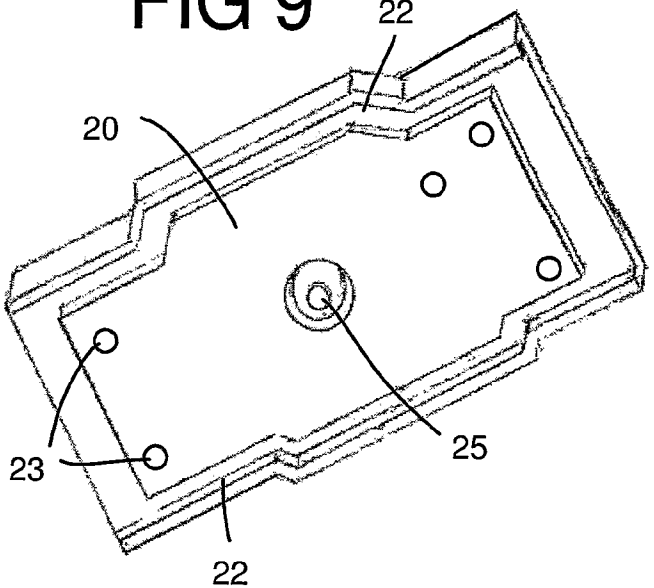
FIG. 9 is a view of the interior face of a bottom plate which will be mounted beneath the flywheel, and which will enclose the bottom of the internal compartment, and which includes grooves into which the side plates will fit and an opening for the drive shaft extending from the flywheel.
Figure 10:
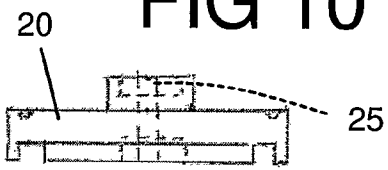
FIG. 10 is an end view of the bottom plate shown in FIG. 9
Figure 12:
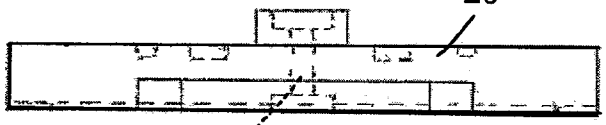
FIG. 12 is a side view of the bottom plate of FIGS. 9-11.

The first embodiment of this invention includes four cylindrical, reciprocal pistons 56A-D, two of which are located on each end of the slide body or slide body piston subassembly 50. This invention is not limited to a four cylinder configuration and other configurations, and their characteristics, will be discussed in more detail after describing the representatives four cylinder embodiments. The pistons 56A-D are joined to the slide central body portion 60 by piston arms 54. Piston arms 54 do not comprise a linkage permitting relative movement between the pistons 56A-D and the central body portion 60 in the sense in which connecting rods form a movable linkage between pistons and the crankshaft of a conventional internal combustion engine. The central body portion 60, the pistons 56A-D, and the arms 54 form the rigid slide body 50, whose motion, in the housing compartment 36, is essentially confined to linear movement parallel to the mutually parallel axes of rotation of the four cylindrical pistons 56A-D. Substantially no angular movement of the rigid slide body 50 relative to any of three orthogonal axes and especially with respect to the cylinders 42 will occur. Since the pistons 56A-D move along coextensive axes of the pistons 56A-D and the cylinders 42A-D, with no side force exerted by rocking piston rods as in a conventional internal combustion engine, there will be relatively little wear on the rings or the cylinder walls 44. Although the pistons 56A-D and the arms 54 can be rigidly attached or fastened to each other and to the central body portion 60, this rigid configuration lends itself to fabricating the slide body 50 as a one-piece member. In the preferred embodiments, the slide body 50 will be die cast as a one-piece member. The one configuration of the slide body 50 lends itself to being cast from a light weight material, such as aluminum or from brass or zinc or other materials so long as the material has sufficient structural strength and integrity to withstand the forces exerted upon the slide body 50 and its constituent elements. The integral slide piston subassembly 50 can also be machined. In the embodiment of FIG. 9, the central body 60 and the arms 54 have substantially the same thickness. It should be understood, however, that the central body 60 would normally not be cast as a member having constant thickness, but instead would have strengthening ribs surrounding sections have less thickness. This common technique results in the removal of material that is not necessary to bear the loads encountered by the slide body piston subassembly 50 and results in a lighter weight structure. In addition to the economies realized by saving material, such a cast web configuration can also accelerate the cooling of the cast material resulting in a lower cycle time and more economic fabrication of the slide body subassembly 50. In some configurations it could be possible to also fabricate the piston arms 54 in a similar web configuration or in a hollow or partially hollow configuration, but the piston arms 54 must have sufficient strength to carry the compressive loads imparted to the pistons 56A-D by combustion during typical internal combustion engine cycles.

The pistons 56A-D can be rigidly attached to arms 54, but preferably the pistons 56A-D are cast as a part of the one piece slide body 50. When pistons 56A-D are cast in this manner, the pistons 56A-D can be cast as shorter cylindrical members. The opposite ends of these integrally cast pistons 56A-D can be substantially parallel, each extending substantially perpendicular to the piston arms 54 and to the central body portion 60. Piston rings 59 will be seated within grooves formed around the pistons 56A-D. These piston grooves can be fabricated as part of the die casting operation in which the integral slide body 50 is fabricated or the piston grooves can be subsequently machined as part of a secondary operation. The linear movement of the rigid piston slide body subassembly 50, and especially of the pistons 56A-D will result in even wear between piston rings 59 and the internal cylinder walls 44. The heads 90 will close off the top of each cylinder 42A-D, and O-rings 110 captured in O-ring grooves 112 in the head 90 will seal each cylinder 42A-D.

The central body 60 is relatively flat and has a height that is less than the outside diameter of the pistons 56A-D. In this embodiment the central body 60 also has a width that is greater than that of the individual piston arms 54, because the piston arms 54 must provide clearance for the pistons 56-A-D to reach top dead center in the respective cylinders 42A-D. The central body 60 also guides the four piston slide body subassembly 50 so that only linear movement is permitted without significant angular displacement during the piston stroke. In a four piston, four stroke, two cycle version of this invention, the individual pistons 56A-D will fire at four different times. Since the axes of rotation of each piston is offset from the center of mass of the slide body 50, there will be a moment created, which could tend to cause the slide body to move angularly if not for the fact that the edges of the central body portion 60 are restrained in this manner. In other words the slide body 50 might tend to cock resulting in a bureau drawer effect. Linear bearings could however be employed to overcome any bureau drawer effect.

The central body portion 60 also includes a push-pull track located on its lower face. This push-pull track extends at an acute angle relative to the axes of the pistons 56A-D as well as to the direction of travel of the piston slide body 50. The track 62 is a formed steel member, which is more resistant to wear than the cast piston-slide body 50. Track 62 has a width sufficient to receive a slide bealing72, which extend upward from one face of the flywheel 70 and be seated in the track 62. As the slide body piston 50 reciprocates, the linear movement of the piston slide body 50 is transmitted through the engagement of the projecting pin 72 with the track 62 to impart rotary motion to the flywheel 70.

The flywheel 70 is mounted below the piston slide body 50. Flywheel 70 is generally parallel to the piston slide body 50 so that the axis of rotation of the flywheel 70 extends perpendicular to the slide central body 50 and to the direction of linear reciprocation of the pistons 56 A-D during each stroke. A drive shaft 74 extends from the opposite face of the flywheel 70 from which the pin 72 projects. In this embodiment, the flywheel 70 is located in the same internal housing compartment 36 in which the piston slide body subassembly 50 is located. The drive shaft 74 extends through an opening of the lower plate or cover 20 to provide a power takeoff on the exterior of the housing 10. The pin or bearing 72 and the pin bearing 76 are offset from the axis of rotation of the flywheel 70, which is also collinear with the axis of revolution of the drive shaft 74. The pin or bearing 72, which engages the piston slide body 50 in track 62, thus revolves around the center of mass and the axis of rotation of the flywheel 70. To insure that the flywheel 70 is balanced around its axis of rotation and that the axis of rotation extends through the center of mass, material can be removed from the flywheel 70.

The flywheel 70 is cast from a material, such as aluminum, in the same manner as the piston slide body 50 and other components of this internal combustion engine 1. The mass of the flywheel 70 can, however, be increased by adding weight around the axis of revolution of the flywheel 70. In the preferred embodiment mass has been added to the flywheel by attaching magnets 80 to the flywheel 70 evenly around the drive shaft 74. The mass of the rotating flywheel 70, including magnets 80, is greater than the mass of the piston slide body subassembly 50 in the first embodiment of this invention. Typically mass is added to conventional flywheels by adding mass to the flywheel rim. In this embodiment, the magnets 80 are located closer to the center of the flywheel 70, and the mass of these magnets is greater than the mass of magnets, or other weights, that could be added adjacent to the flywheel rim and would result in the same moment of inertia. The magnets 80, are however to be used for the generation of electric current, in a manner which will be subsequently be described in more detail, and larger magnets 80 are suitable for that purpose. Therefore it was deemed appropriate to employ larger magnets 80 closer to the flywheel axis of revolution instead of smaller magnets adjacent the periphery of the flywheel 70.

In the main representative embodiment, the flywheel 70 is located within the housing compartment 36. It should be understood however that a separate rotating disk, including a drive pin, could be mounted on the interior of the housing, and the flywheel could be mounted outside the housing 10. An intermediate shaft would join the separate rotating disk and an external flywheel in this alternative configuration. The main representative embodiment would, however, accomplish the same result with fewer parts.

The flywheel 70 functions as an energy storage device to dampen or reduce the fluctuations or variations of the velocity of the piston subassembly 50 during each stroke. Obviously the force acting on the piston subassembly 50 during combustion and during the initial stages of the expansion stroke of any one piston 56A,B,C or D is greater than during later stages of each stroke, especially as the fuel air mixture is compressed in another cylinder 42A,B,C or D. The energy stored by rotation of the flywheel 70 will tend to reduce these velocity variations and smooth reciprocal movement of the piston slide body 50. However, it should be understood that while a flywheel is advantageous, it could be replaced by a crank.

The energy storage function of flywheel 70 is similar to flywheel energy storage in other conventional internal combustion engines. It is currently believed, however, that the flywheel 70 serves an additional function in the present invention. In the absence of other forces acting on the flywheel 70, the angular momentum of the rotating flywheel 70 will tend to remain constant. The direction of the angular momentum vector would also remain unchanged. When other forces act on the flywheel 70 the inertia of this flywheel 70 should make it more difficult for these forces acting on the flywheel 70 to change the direction of the angular momentum vector. In other words the angular momentum of the flywheel 70 will tend to dampen or reduce movement or vibrations, which might arise from other forces. Since the piston subassembly 50 moves in only one direction at any one time, there will be no tendency of oppositely moving pistons to balance the reaction forces acting on the engine housing as would be the case for conventional engines. However, the flywheel 70, which is connected to the housing, will tend to dampen any reaction forces acting on the engine housing 10 as a result of movement of the piston slide 50 in the opposite direction. Flywheel 70 thus serves to dampen any adverse effects arising from the elimination of pistons moving in opposite directions. Stabilizing this internal combustion engine 1 in this manner will make it more suitable for use in mobile vehicles, such as motor vehicles, air planes, lawn, garden and agricultural vehicles as well as in other off road applications. This description of the function of the flywheel 70 is currently believed to be accurate, but it is added here in an attempt to more completely describe the function of this internal combustion engine and its various components. This description is not intended to be limiting however, and any inadequate current understanding of the physics of this manner this engine and its operation does not limit the device as otherwise disclosed herein.

Figure 13:
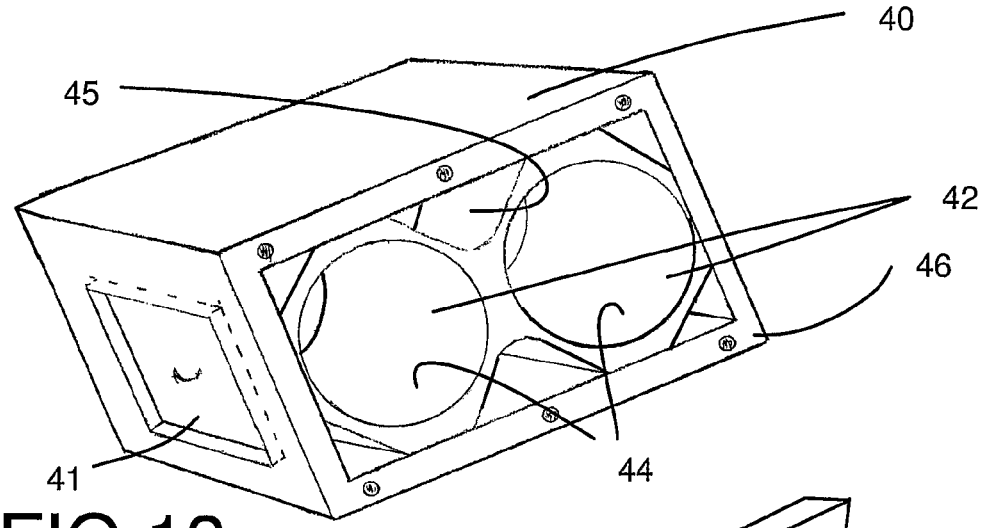
FIG. 13 is a view of one of the cylinder bodies, each of which has two cylinders, as well as surrounding voids though which coolant will be circulated.
Figure 14:
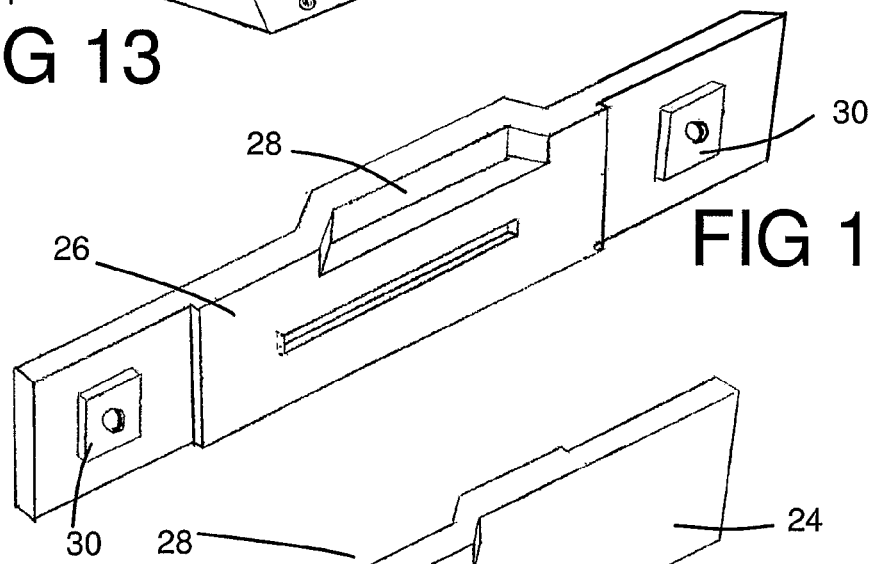
FIG. 14 is a view of and internal face of one of the side plate that will enclose the internal compartment and which will mate with the cylinder bodies at either end.
Figure 15:
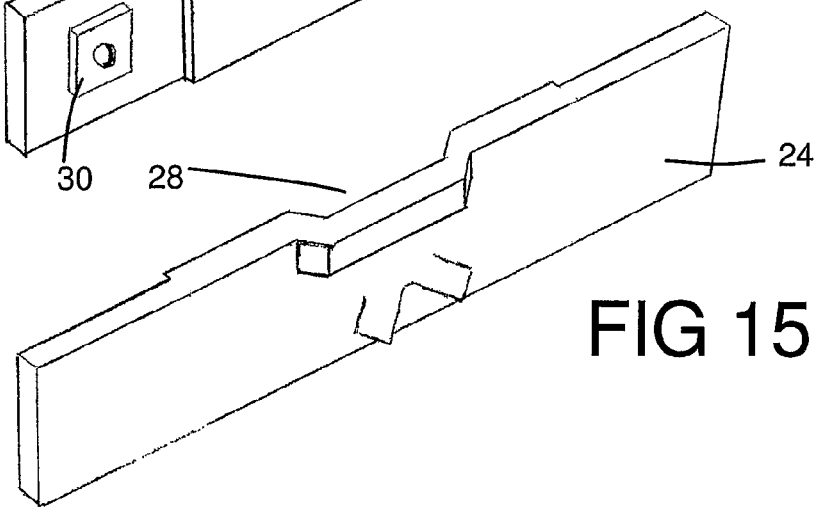
FIG. 15 is a view of the external face of one of the side plates.
Figure 16:
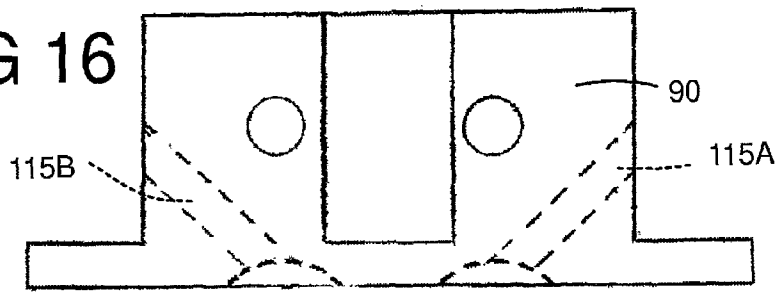
FIG. 16 is a top view of one of the cylinder heads which will be secured to the opposite outer ends the two cylinder bodies shown in FIG. 13.
Figure 17:
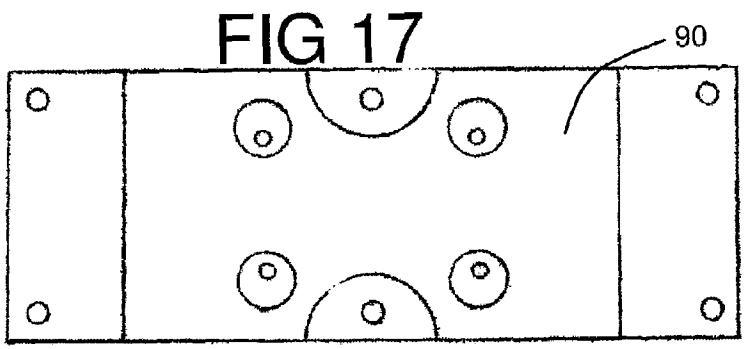
FIG. 17 is an end view showing the external face of the head shown in FIG. 16.
Figure 18:
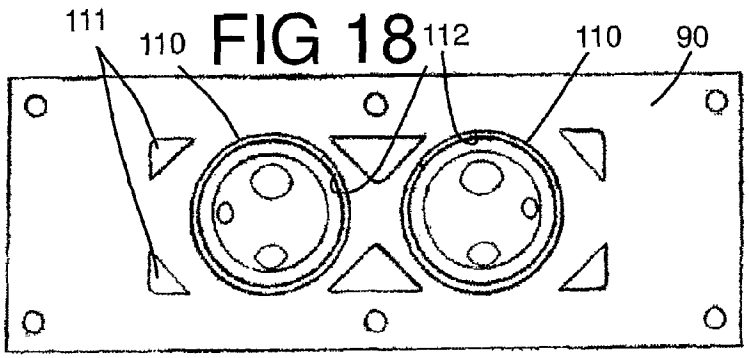
FIG. 18 is an opposite end view of an internal face of the cylinder head, which will enclose two cylinders when secured to a cylinder body at each end of the engine.
Figure 19:
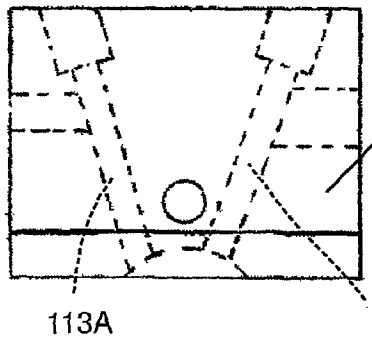
FIG. 19 is an end view of the cylinder head of FIGS. 16-18.
Figure 20:
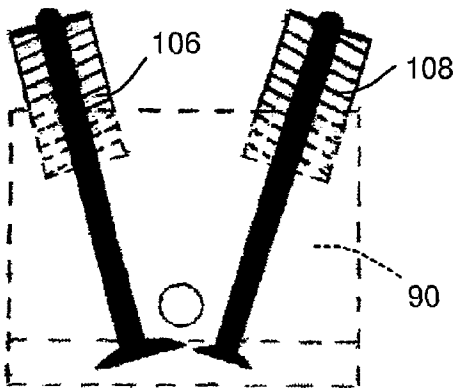
FIG. 20 illustrates the positions of the intake and outlet valves communicating with each cylinder through the cylinder head.
Figure 21:
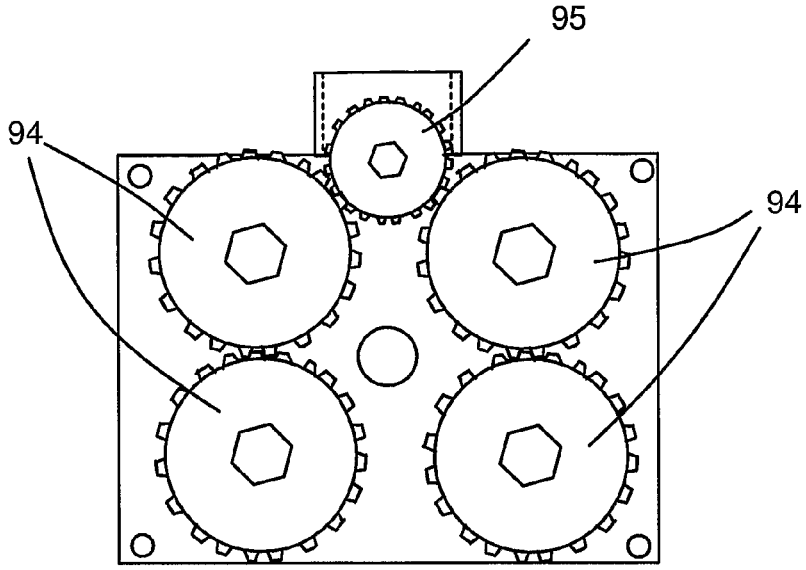
FIG. 21 is an end view of the valve cam gears, which will be mounted on the outer ends of the cylinder heads and which will open the valves shown in FIG. 20.
Figure 22:
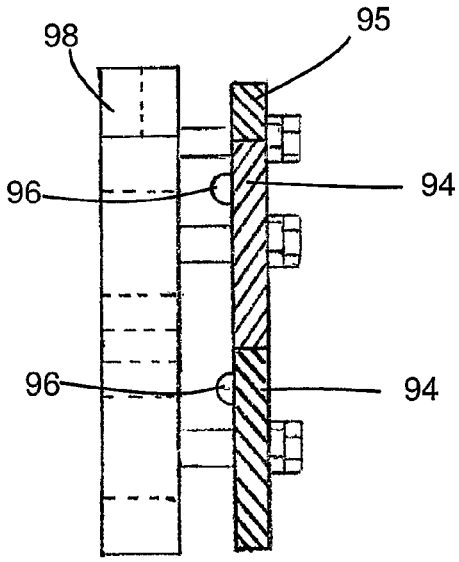
FIG. 22 is an end view of the valve cam gears, also showing the valve drive gear, which will is mounted on a cam drive shaft to drive the four valve cam gears.

The combustion chamber of this engine is bounded by the cylinders 42A-D, the respective pistons 56A-D, and the heads 90. The heads 90 close off head ends of the cylinders 42A-D. The cylinder bodies 40A and 40B are attached to the side plates 24 and 26. Each cylinder body 40 comprises a cast member in which the internal cylinder walls 44 extend from a cylinder body inwardly facing face 46. The cylinder body is evacuated around the cylinder walls 44 as seen facing toward the center of the engine housing as shown in FIG. 13. This evacuated area serves as a conduit for coolant in a manner to be subsequently discussed in greater detail.

The valve-cam-gear mounting plates 98, are attachable to the heads 90 which serve to close off distal ends of the cylinders 42A-D, and plate 98 serves as the means to mount other components on the heads 90A and 90B. A cast aluminum head 90 is shown in more detail in FIGS. 16-20. Intake valves 106 and outlet valves 108 are mounted within a recess 113A and 113B in the heads 90 in alignment with each corresponding cylinder 42 on each side of the engine 1. Conventional sparkplugs, not shown, are mounted in recesses 115A and 115B. O-rings 110 in O-ring grooves 112 recessed in the heads 90 surround each concave recess and the two valves for each cylinder 42. These O-rings 110 eliminate the need for a gasket surrounding the head of each cylinder 42. These O-rings are positioned to engage the outer faces of the internal cylinder walls 44. Of course, a gasket could be employed instead of or in addition to the O-rings if desired.

Figure 23:
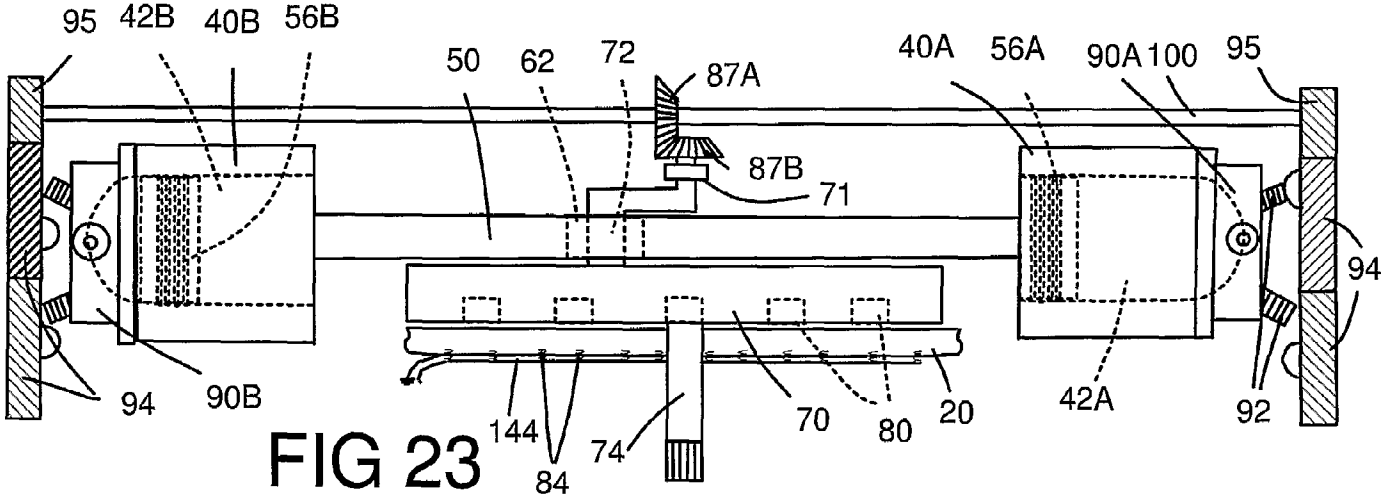
FIG. 23 is a schematic view showing the position of the main engine components including the slide body with integral pistons, the flywheel, the cylinder-head-valve subassemblies, and showing how the valve cam drive shaft will be rotated as the piston slide body reciprocates relative to the stationary cylinders.
Figure 24:
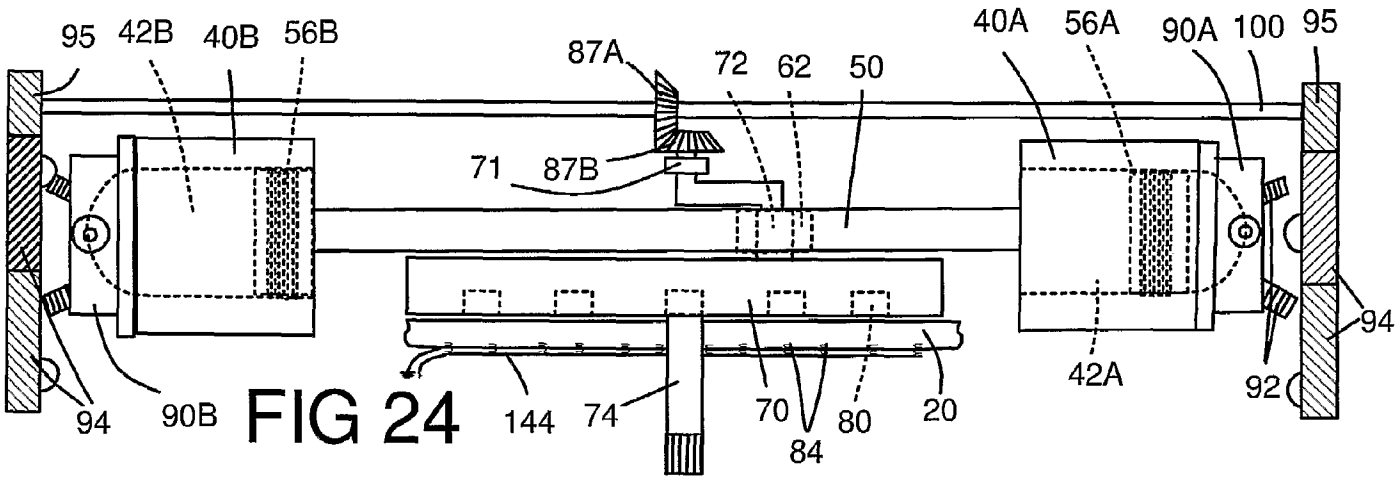
FIG. 24 is a schematic view similar to FIG. 23, showing movement of the components as the piston slide body has moved from a left top dead center position in FIG. 23 to a right top dead center position in FIG. 24.

Cam gears 94 are mounted on the opposite side of the mounting plate 98. Four cam gears 94 are located on each end of the engine so that one cam gear 94 will activate one of the four valves 106, 108. Two cam gears 94 are positioned in alignment with each cylinder 42, and the teeth mesh on cam gears 94 of each pair. Cams 96 on the inside of each cam gear 94 will engage the corresponding valve 106, 108 as each cam gear rotates. Individual cam gears 94 can be separately removed for repair after removal of the valve cover 104. The relative positions of the cams 96 can be adjusted, repositioned or realigned by removing a corresponding cam gear and replacing the same cam gear in a different angular position A valve cam shaft 100 extends between above the slide body 50 between opposite ends of the engine 1, as shown in FIG. 23. Conventional bearings, not shown, support the cam shaft 100 as it rotates. A bevel gear 87A is located adjacent to the center of the shaft 100, and bevel gear 87A engages bearing gear 87B, which is mounted on an offset crank or shaft, which is in turn attached to the flywheel 70. A bearing 71 centers the offset shaft just below the bevel gear 87B, and the bevel gear 87B is located on the axis of rotation of the flywheel 70. As the slide body 50 reciprocates from end to end, the flywheel 70 is rotated by movement of the shaft and surrounding bearing block 72 within the angled track 62 in the central portion of the slide body 50. Comparison of FIGS. 23 and 24 shows that the bevel gear 87B rotates in unison with the flywheel 70, which imparts rotation of the valve cam shaft 100 through the companion bevel gear 87A.

A cam drive gear 95 mounted on each end of a valve cam shaft 100 drives the cam gears 94 of each pair. Rotation of valve cam shaft 100 thus imparts rotation to the cam gears 94 and causes the valves 106, 108 to open in proper sequence in relation to the position of the corresponding pistons 56A-D. Valve cam shaft 100 extends between opposite ends of the engine 1 above the internal housing compartment 36 in which the slide body 50 is located.

Figure 6:
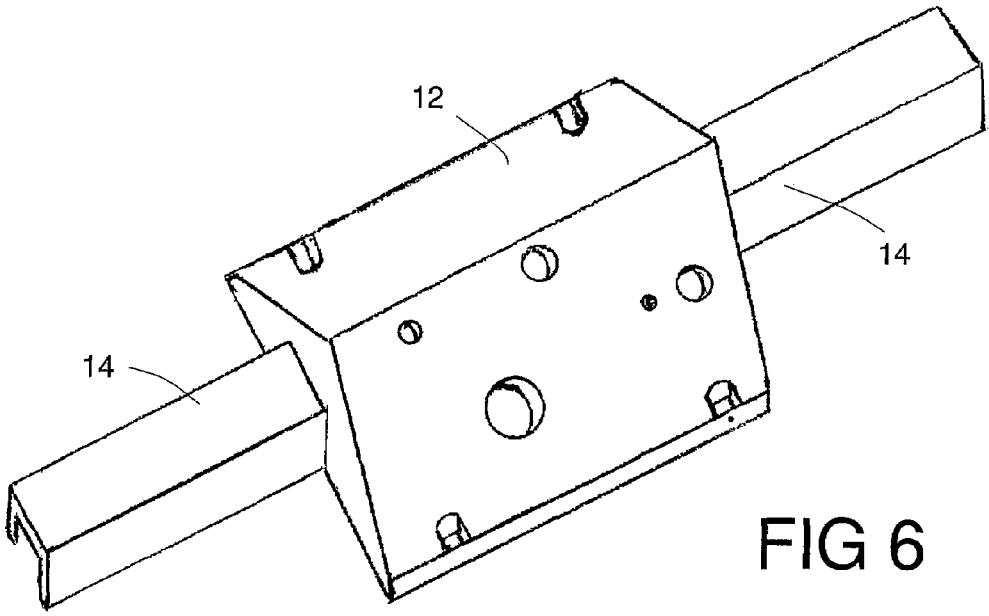
FIG. 6 is a view of the shroud, which will be assembled to cover the central portion of the engine assembly shown in FIG. 1.
Figure 7:
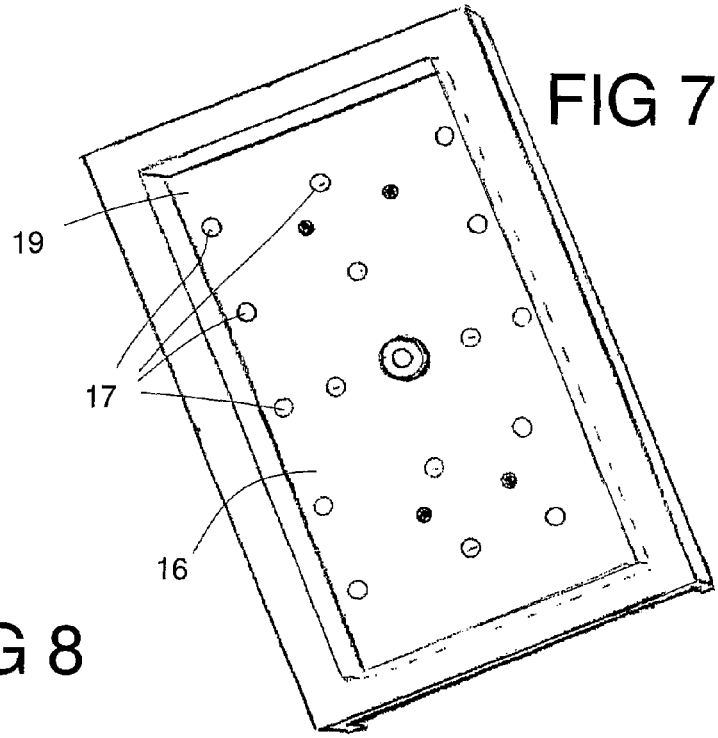
FIG. 7 is a view of a top plate, which is mounted beneath the shroud, shown in FIG. 6, and which will be mounted on top of the subassembly shown in FIG. 2 and in engagement with the side plates and between the cylinder bodies, and which will include a plurality of holes though which lubricant can be admitted into the internal compartment.
Figure 8:
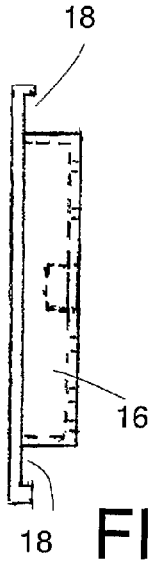
FIG. 8 is a view of the top plate shown in FIG. 7.

A shroud 12, which is mounted on the top cover plate 16, encloses the top of the housing compartment 36 as well as the valve cam shaft 100. Shroud 12 is shown in FIG. 6. Openings are located on opposite ends of the shroud 12 to provide clearance for the valve cam shaft 100. Pick up sensors for a coil pack can be mounted on the shroud 12.

Valve covers 104 are mounted on opposite ends of the housing 10, and each valve cover surrounds the valve and cam assembly on the end of the heads 90A and 90B. The valve covers contain gear oil lubricating the cam gears 94 and the cam drive gear 95 as in a gear box. Valve covers 104 can also include fins to more efficiently radiate heat.

Figure 42:
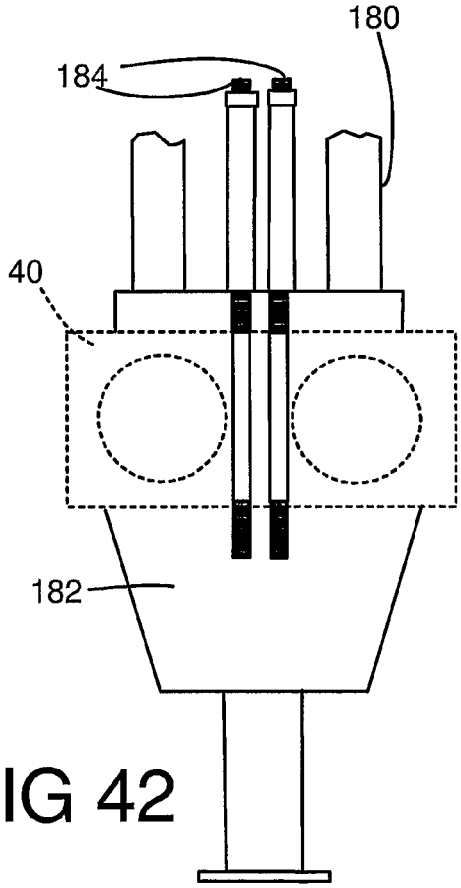
FIG. 42 is a view of a means of mounting an intake manifold and an exhaust manifold on the engine.

As shown in FIG. 42, intake manifolds 180 and 182 can be easily assembled. Studs 186 extend above each cylinder body 40, and nuts 184 are located at the ends of the studs. Intake manifold 180 can be secured to the engine merely by nuts 184, which allows both easy assembly and disassembly.

The basic internal components for imparting linear motion to the piston slide body 50 by the sequential combustion of a fuel-air mixture in the cylinders 42A-D, and for conversion of this linear motion to a rotary motion for output via a drive shaft 74 have now been discussed. However, one important feature of this mechanism is the ease with which it can be assembled, dissembled and serviced. The construction of the main housing 10 contributes largely to these advantages. The housing 10 includes an upper plate or cover 16 partially surrounded by an upper shroud 12, a lower plate or cover 16, two side plates 24, 26 and the two cylinder bodies 40A and 40 B at either end of the main engine housing 10. The two side plates 24 and 26 are captured at their upper and lower edges by interfitting grooves 18 on the upper cover plate 16 and lower intermitting grooves 22 on the lower cover plate 20. Upper cover plate 16 and lower cover plate 20 thus serve to hold the side plates 24, 26 in proper lateral position to define the top and sides of an internal housing compartment 36 in which both the piston slide body central portion 60 and the flywheel 70 are confined. The upper cover plate 16 is externally secured to the lower cover plate 20 on exterior of the side plates 24, 26. The cylinder bodies 40A and 40 B are fitted between recessed side faces 30 at opposite ends of the internal compartment 36 between end sections of the side plates 24 and 26. A protruding, generally rectangular protuberance 27 on each side plate 24 or 26 fits within a correspondingly shaped depression on the side of the cylinder bodies 40A and 40B. The relatively tight fit between the rectangular protuberance 27 and the depression 41 holds the cylinder bodies 40A, 40B and the side plates 24 and 26. A silicone sealant can be used to seal this joint as well as other joints of the interfitting housing components. The pistons 56A-D are positioned within the cylinders 42A-D before the side plates 24 and 26 are attached to the cylinder bodies 40A and 40B.

The sequence of steps for disassembling the internal combustion engine 1 illustrate the simplicity of servicing this engine and conversely the simplicity of its construction. After the engine is removed from the frame in which it is mounted, the valve covers 104 are removed as the first stage of the engine disassembly. The next step in breaking down the engine 1 is to remove the upper shroud 12 by removing clamps 21 securing the upper cover plate 16 to the lower cover plate 20. The valve cam shaft 100 is not free and can be removed. The upper cover plate 16 is now free and can be lifted off of the side plates 24 and 26, which are then held in place only by the lower interfitting grooves 22. Removal of the lower plate 20 will then free both the side plates 24 and 26 from the cylinder bodies 40A and 40B. Removal of the lower cover plate 20 also permits removal of the flywheel 70, which is typically removed with the lower cover plate 20. The flywheel 70 must be removed from the bottom because a tapered cavity 28 is formed on the interior of each side plate 40A and 40B to provide sufficient clearance for a flywheel 70, whose outer diameter is larger than the width of the piston slide body central portion 60. After the side plates 24 and 26 have been removed, the only remaining components are the piston slide body 50 with the pistons 56A-D still positioned within the cylinders 42A-D. Each cylinder body 40A and 40B can be removed from the slide body 50 freeing the pistons 56A-B, and disassembly of the engine 1 is now complete.

Liquid coolant is also dispersed by an external electric water or fluid pump, which although not shown, can be connected to the coolant intake 116 and exhaust 118 located on the side plate 24. The liquid coolant or water is transported between opposite ends of the main housing 10 through conduits embedded in the side plates 24, 26, generally along the path shown in FIG. 28. Coolant apertures communicate with this internal conduit in each side plate. Mating apertures 43, located in the cylinder bodies 40A and 40B also communicate with the void space surrounding each of the cylinders 42A-D, as shown in FIG. 13. This void space, which provides room for coolant to surround cylinders 42A-D is best seen in FIG. 13. Openings 111, which communicate with internal passages in the head 90, also permit coolant to be circulated through the heads 90. Using these internal conduits and void passages, which can be part of original castings or can formed by secondary machining operations, permits coolant to circulate within the engine components and recirculation by the external water pump.

Figure 29:
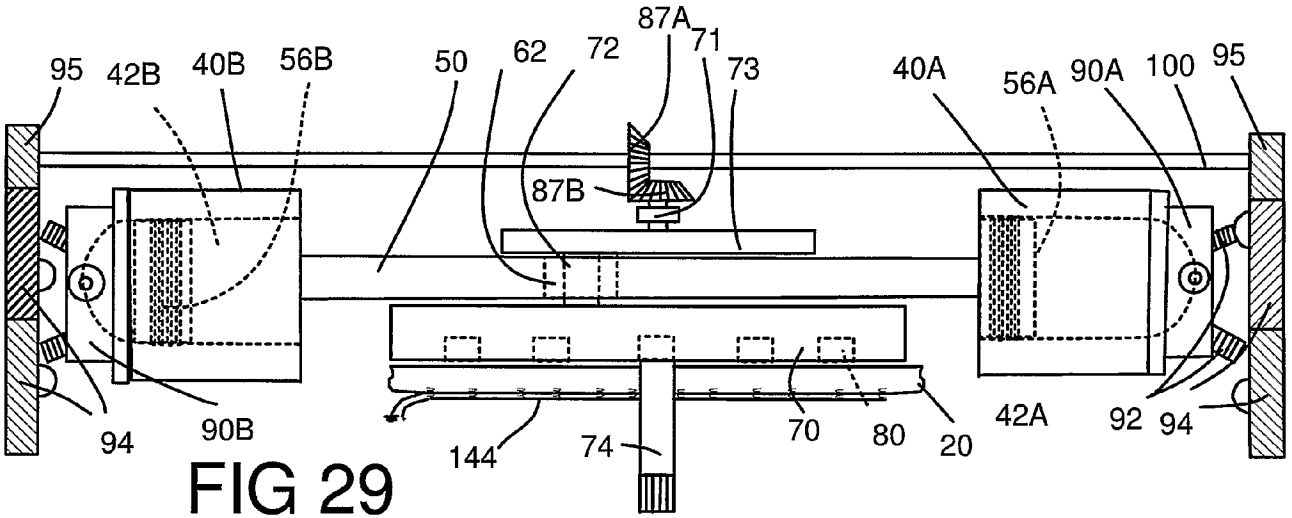
FIG. 29 is a view similar to FIG. 23 showing an alternate configuration including a rotating disk, which will assist in slinging oil as the fluid lubricant is feed into the internal compartment from above.
Figure 30:
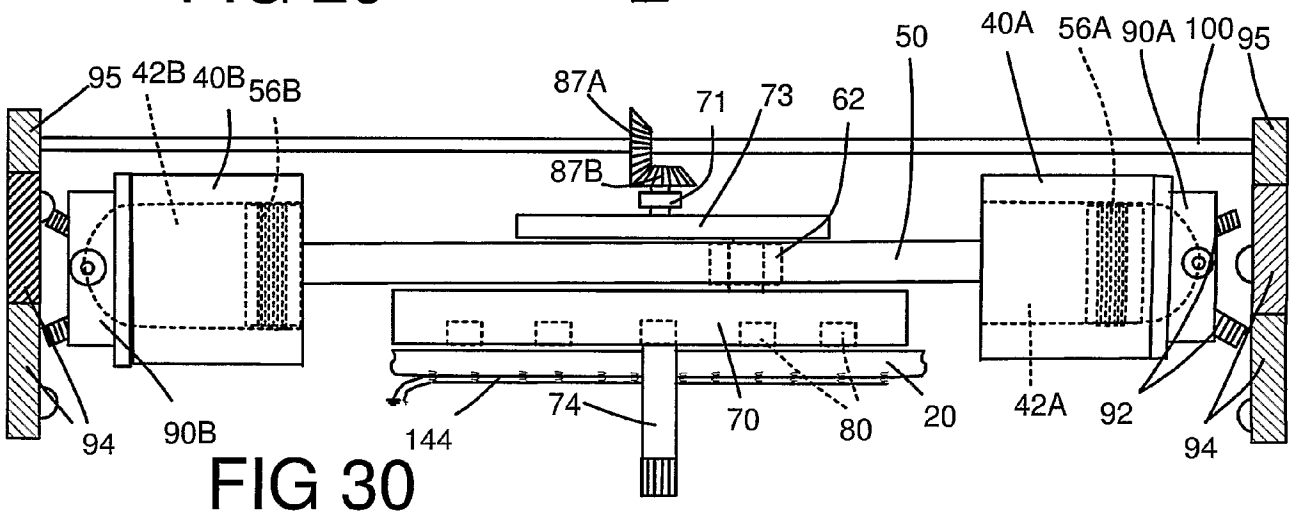
FIG. 30 is a view similar to FIG. 24 showing movement of the slide body relative to the position shown in FIG. 29

A mechanical or an electric oil pump, not shown, can be employed to circulate oil or other fluid lubricants through the engine 1. The oil pump can be located at any number of positions. Oil will be introduced into the engine 1 through the shroud 14 at the top of the engine 1, and gravity will assist in dispersing the oil. A plurality of openings 17 are provided in the top plate 16, which is positioned beneath the shroud 12. Oil will flow through these openings onto the slide body 50 and the flywheel 70, where it will be dispersed laterally. The rotating offset shaft between the bevel gear 87B and the bearing 72 will tend to laterally disperse the oil. An alternative embodiment of this invention is shown in FIGS. 29 and 30. This embodiment includes a rotating disk 73 located between the bevel gear 87B and the bearing 72.

Figure 11:
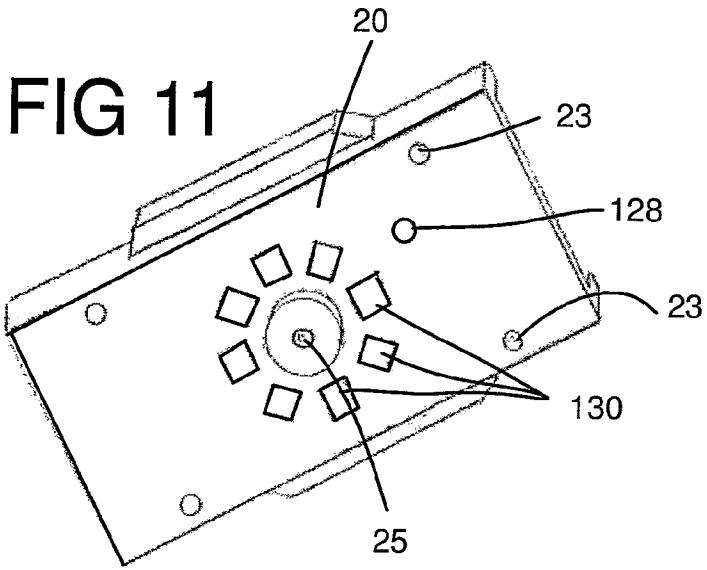
FIG. 11 is a view of the external face of the bottom plate of FIGS. 9 and 10, showing external cavities which will receive coils in which an electrical current will be induced as the magnets in the rotating flywheel move past the coils.

This disk 73 will rotate relative to the slide body 50 and will sling oil laterally within the internal compartment 36 formed between side plates 24 and 26 and the covers 16 and 20. FIG. 33 shows one version of the bearing assembly 72 which will be lubricated by oil dispersed in this manner. This bearing assembly includes a slide block 72A, which will be received in the slotted track 62A. Since the length of the track 62A is greater than the length of the slide block 72A, this slide block will reciprocate in the track 62A. The slide block 72A receives a portion of the shaft 72B, which extends between the bevel gear 87B and the flywheel 70 to which it is secured by threads at the end of this shaft. The hole 72C, which receives the shaft section 72B has a series of longitudinal grooves and the shaft 72B, also includes longitudinal grooves 73B. These grooves provide space for oil to flow through the slide block 72A to fully lubricate the block-shaft interface. The slide block 72A also has grooves 73A along opposite faces, which are juxtaposed to the track 62A when in operation. These grooves 73A also permit the introduction of sufficient lubricant so that the slide block 72A can move within track 62A, without excessive friction, which could damage this assembly. Oil is also dispersed along the edges of the slide body, between the slide body 50 and the side plates 24 and 26. Linear gear bearings which can be used at this interface are subsequently discussed with reference to FIGS. 29 and 30. When the engine 17 is intended to be horizontally mounted, the oil will then flow through an exit opening 128 in the lower cover 20 as shown in FIG. 11, where it will then be recirculated by an oil pump.

Figure 25:
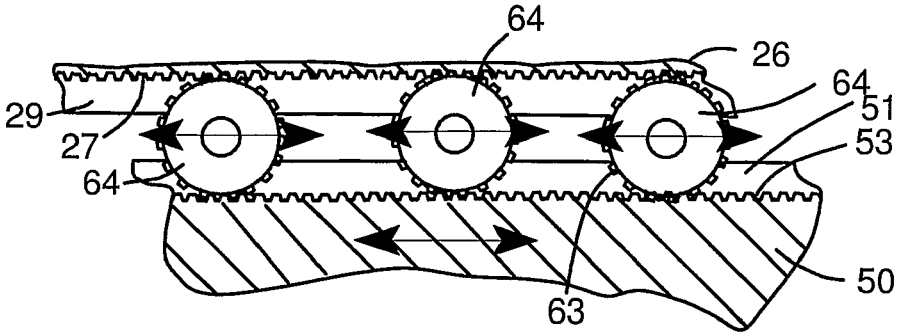
FIG. 25 is a view of a series of linear gear bearings that can be mounted between the slide body and each side plate to stabilize linear movement of the slide body and to eliminate any bureau drawer effect during linear movement of the slide body.
Figure 26:
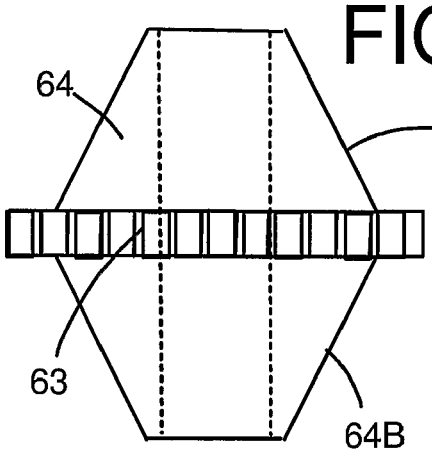
FIG. 26 is a side view of one of the linear gear bearings shown in FIG. 25.
Figure 27:
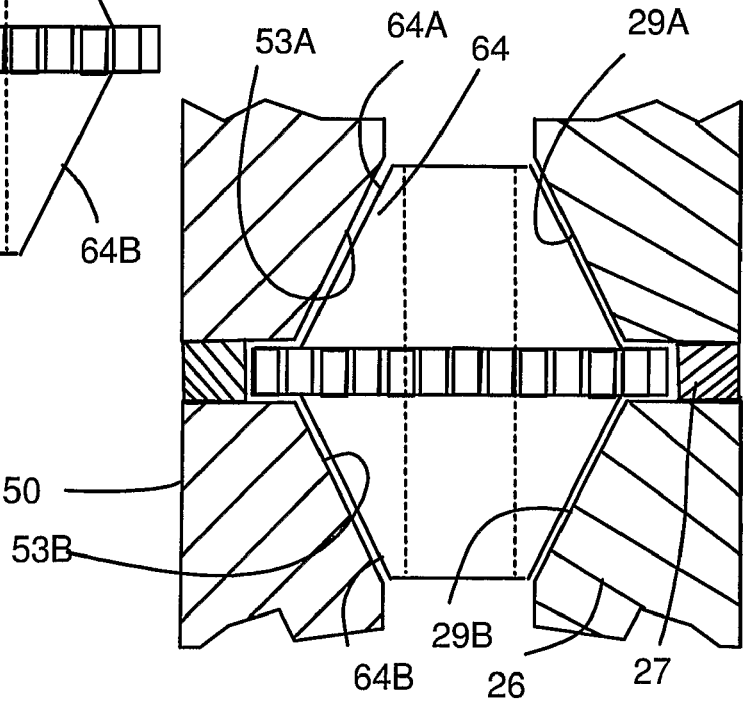
FIG. 27 shows a linear gear bearing of FIGS. 25 and 26, located within opposed tapered grooves between the slide body and an adjacent side plate.

A linear gear bearing assembly is shown in FIGS. 25-27. This gear bearing assembly comprises a series of gear bearings 64 positioned between linear gears 27 and 53. This gear bearing assembly can be employed between the side edges of the central portion 60 of slide body 50 and the side plates 24 and 26. This gear bearing will counteract any bureau drawer effect as the slide body reciprocates from end to end relative to the stationary side plates 24 and 26. The bureau drawer effect would occur if the slide body 50 tended to rotate about an axis perpendicular to the plane of the central slide body portion 60. Since each of the four pistons 56A-D are offset relative to a centerline of the slide body 50, there would be a moment tending to impart rotation about this axis. Each gear bearing 64 has a series of gear teeth 63 extending circumferentially between an upper conical surface 64A and a lower conical surface 64B. As shown, each of these conical surfaces form a frustum of a cone. These circumferentially extending gear teeth 63 engage the linear gear teeth 27 and 53. The upper conical surface 64A will be juxtaposed to an upper inclined surface 53A along the edge of the slide body 50, and the lower conical surface 64B will be juxtaposed to a lower inclined surface 29B on one of the side plates. A gap will be formed between the conical surfaces and the inclined surfaces so that oil or any suitable lubricant can be gravity fed between these opposed surfaces. Since these opposed surfaces are inclined, tapered or conical, they will prevent any significant displacement of the slide body 50 relative to the side plates 24 and 26. Since a series of gear bearings will be employed, the slide body 50 will not be able to cock towards and away from the side plates 24 and 26 in a manner characteristic of the bureau drawer effect. Since these gear bearings 64 will remain in engagement with the linear gears 27 and 53, they will not tend to gather or bunch up due to inertia as the slide body moves back and forth at a relative significant rate. Although these gear bearings 64 are here used between linearly reciprocating members, they can also be used between rotating members, such as a shaft and a bushing. Other alterations are also possible. For instance the inclined surfaces and the linear gears may be separate members that can be attached to the two bodies that move past each other. In some applications, including the present internal combustion engine, the lower inclined surfaces 29B and 53B may be extended below the gear bearing to restrict the passage of oil through the bottom of this assembly.

The main embodiment of the internal combustion engine 1 includes a single slide body 50 having four pistons 56A-D, two side-by-side pistons being located on opposite ends of the piston slide body subassembly 50. Alternative configurations can be employed. For instance, multiple slide body pistons 50 can be stacked one on top of each other. So long as both slide body piston subassemblies 50 move in the same direction, only one flywheel need be employed. If two slide bodies move in opposite directions, two flywheels can be employed, one connected to each slide body. The force generated by each pair can be transferred to a single drive shaft by conventional means. Alternatively, the same slide body can employ additional pistons extending above or below primary pistons located in the same major plane as the central slide body portion.

Figure 31:
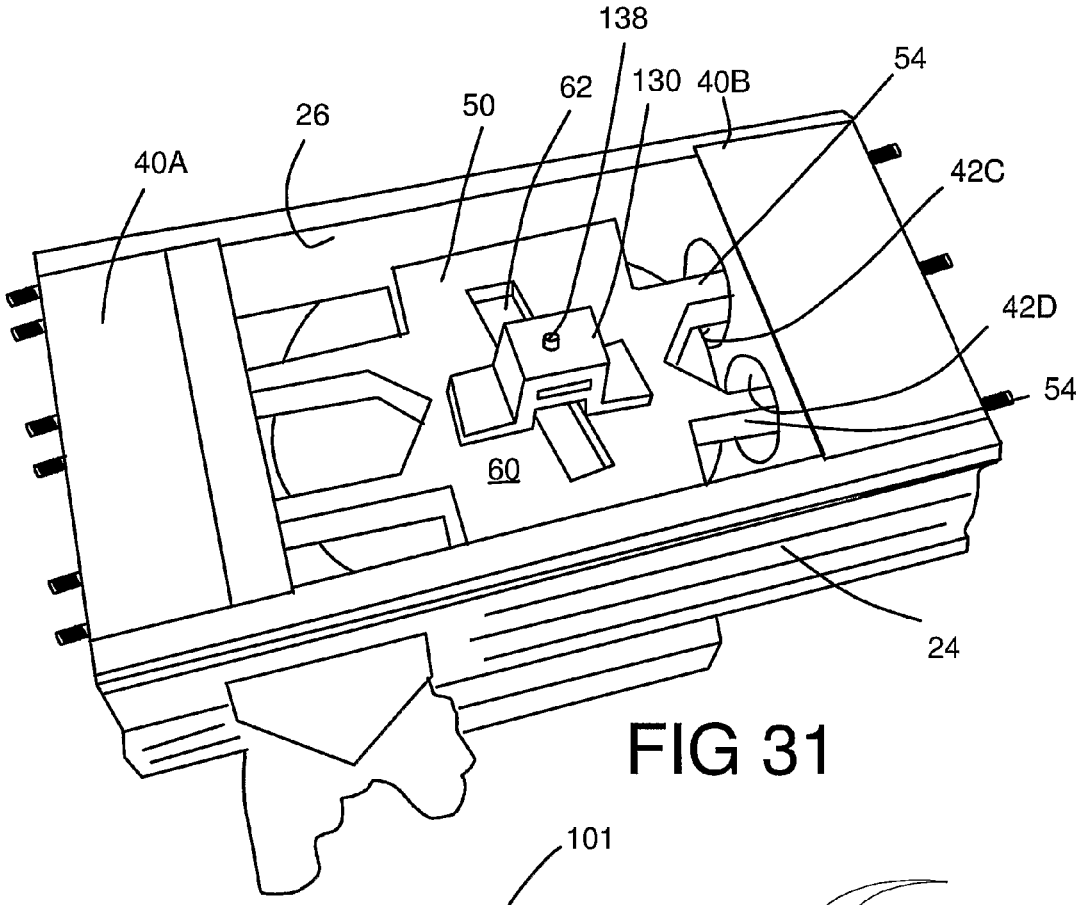
FIG. 31 is a view similar to FIG. 2 of another alternate embodiment in which a cam pin mounted on top of the slide body is positioned to impart rotation to a cam drive shaft as the slide body reciprocates from end to end.
Figure 32A:
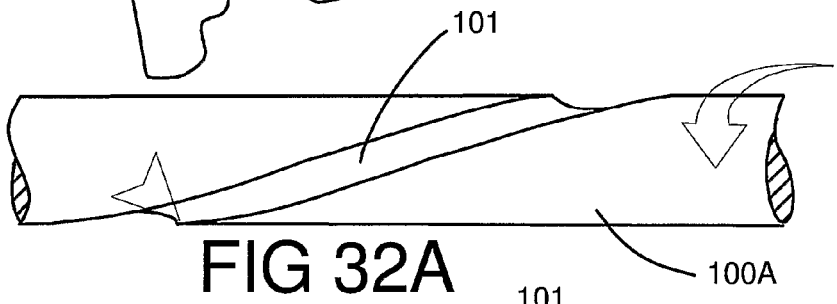
FIGS. 32A and 32B are two views showing engagement of the cam drive pin shown in FIG. 31 in a continuous follower groove on the periphery of the cam drive shaft to impart rotation to the valve drive shaft.
Figure 32B:
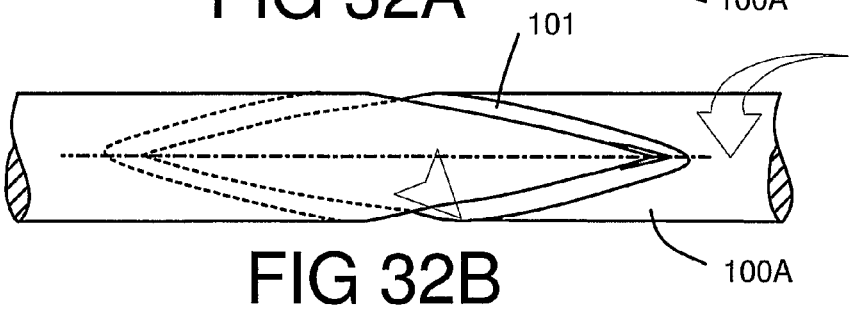

The representative embodiments discussed so far are not the only configurations that could employ a slide body arrangement of the type previously discussed. FIGS. 31 and 32 show a different means for activating the valves that does not employ the beveled gear mechanisms shown in FIG. 23 and 24 and in FIGS. 29 and 30. In this embodiment, a yoke 136 mounted on the slide body, above the track 62 includes a pin 138. This pin 138 would engage a groove 101 on a valve drive shaft 100A as shown in FIGS. 32A and 32B. The valve drive shaft 100A has rotated through an angle of one hundred eighty degrees as the slide body 50 and the pin 138 move between the shaft positions shown in FIGS. 32A and 32B. As the slide body 50 reciprocates, the pin 138 travels around the groove 101 imparting rotation to the valve drive shaft 100A in the direction of the arrow to actuate the valves in the manner previously discussed. The pin 138 will engage the leading edge or bank of the groove 101A, as indicated by the arrowhead, as the slide body 50 and 138 move in opposite directions to impart rotation in the same direction regardless of the direction of movement of the pin 138.

Figure 34:
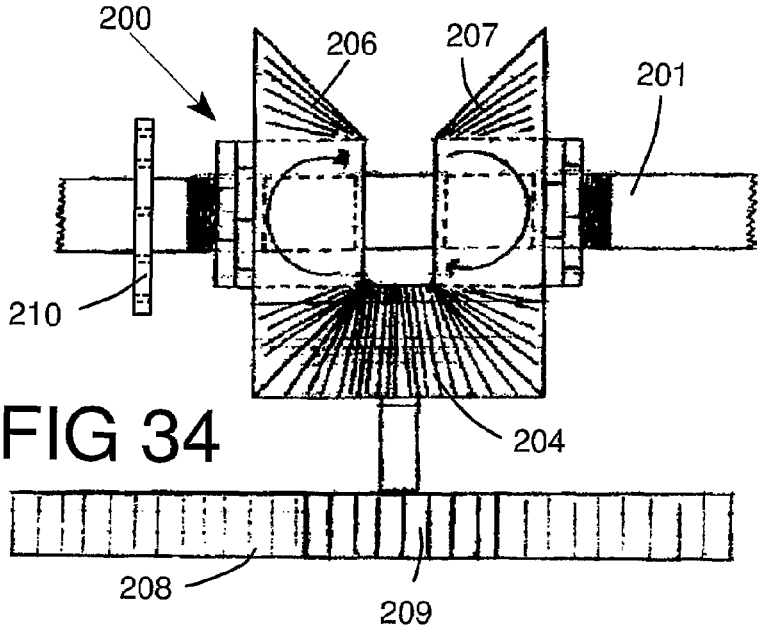
FIG. 34 is a view of an alternate arrangement for driving a valve drive shaft including a pair or oppositely rotating bevel gears driven by a drive gear that rotates in opposite directions as the slide body reciprocates.

FIG. 34 shows another alternative subassembly 200 employing bevel gears driven by movement of the slide body 50. A gear rack 208, mounted on the slide body 50 turns a gear 209 and shaft 205 on which a drive bevel gear 204 is mounted. Drive bevel gear 204 therefore rotates in opposite directions as the slide body 50 moves in opposite directions. Bevel gears 206 and 207 are driven by drive bevel gear 204 to rotate in opposite directions. Gears 206 and 207 incorporate conventional clutch bearings so that each gear 206 and 207 can engage the shaft 201 and rotate the valve drive shaft 201 in only one direction. Thus the shaft 201 always rotates in the same direction to drive cam gears mounted on opposite ends, even though all three bevel gears rotate in opposite directions.

The various embodiments discussed so far all employ a rotating valve cam shaft and a drive gear 95 to rotate cam gears 94, which include cam lobes 96 as either integral or attached components on the interior surface of the cam gears 94. Valve shafts 100 can be driven either by a pin and groove method or by a gear and crank method depending on the horse power of the particular engine for which this invention is employed. For smaller horsepower engines the configuration of FIGS. 31 and 32A and B can be employed. In that version, the pin 138 drives a elliptical groove 101, that encircles the center of the valve shaft 100. The inner bank peak or edge of this groove follows the centerline of the shaft axis and the outer bank peaks or edes are offset in order for the pin 138 to clear the inner bank peaks. A clutch bearing can be incorporated as a backup feature in order to insure that the valve shaft 100 always rotates in the same direction. Due to the offset of the outer bank peak, the vavle shaft 100 will not turn for a minute distance as the slide body and pin 138 reverse directions. For small horsepower, this is not a problem.

Figure 35:
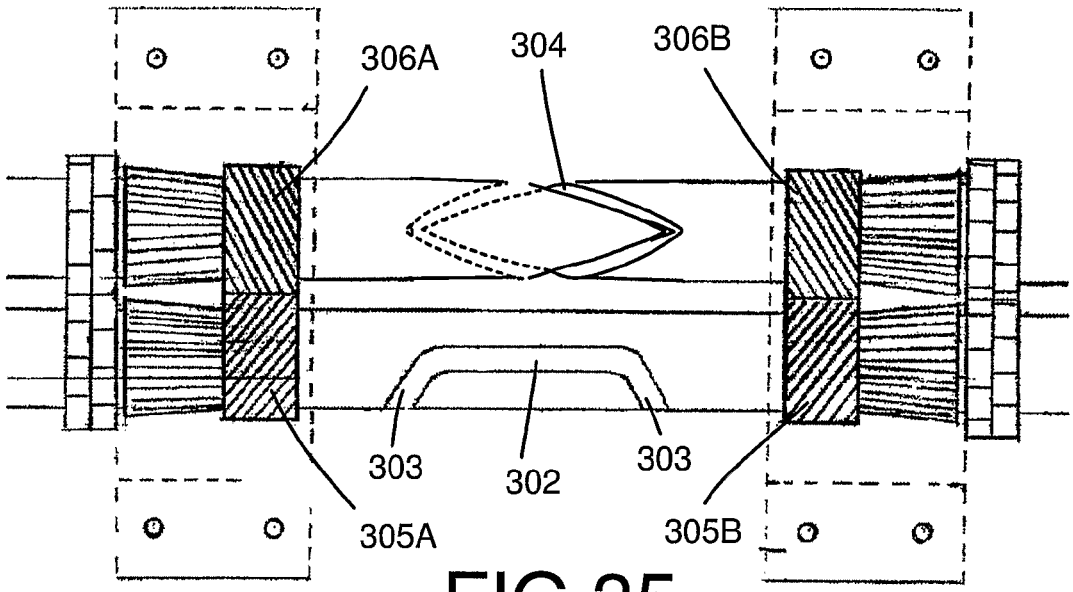
FIG. 35 is a view of another alternate arrangement for driving a valve drive shaft including a secondary shaft which causes the vavle drive shaft to continuously rotate in the same direction as the main drive pin changes direction.
Figure 36:
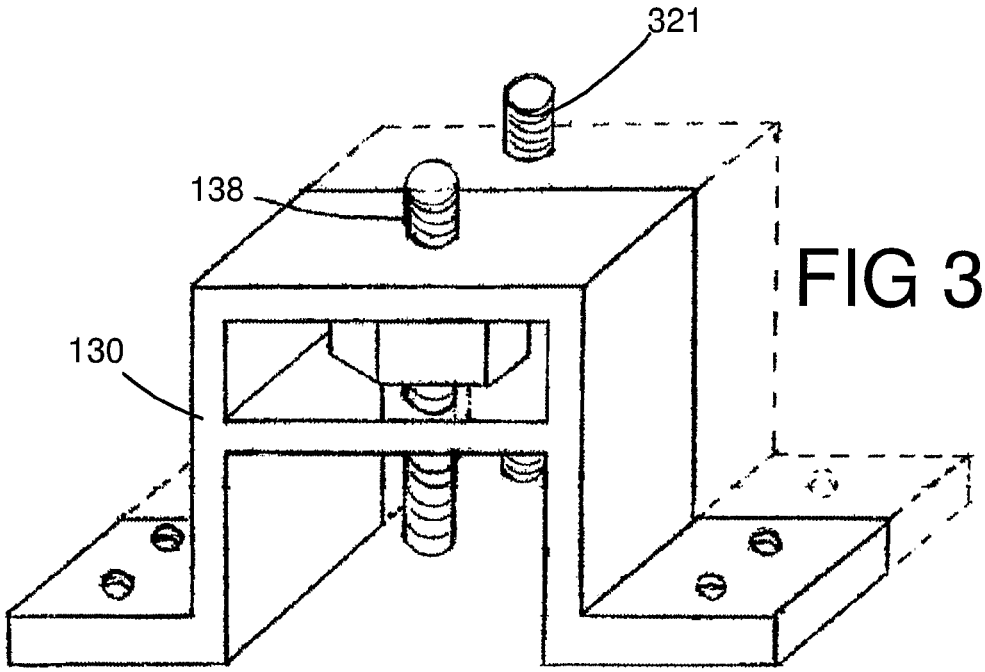
FIG. 36 is a view of an arrangement for mounting dual pins on a slide body for driving the two shafts shown in FIG. 35.
Figure 37:
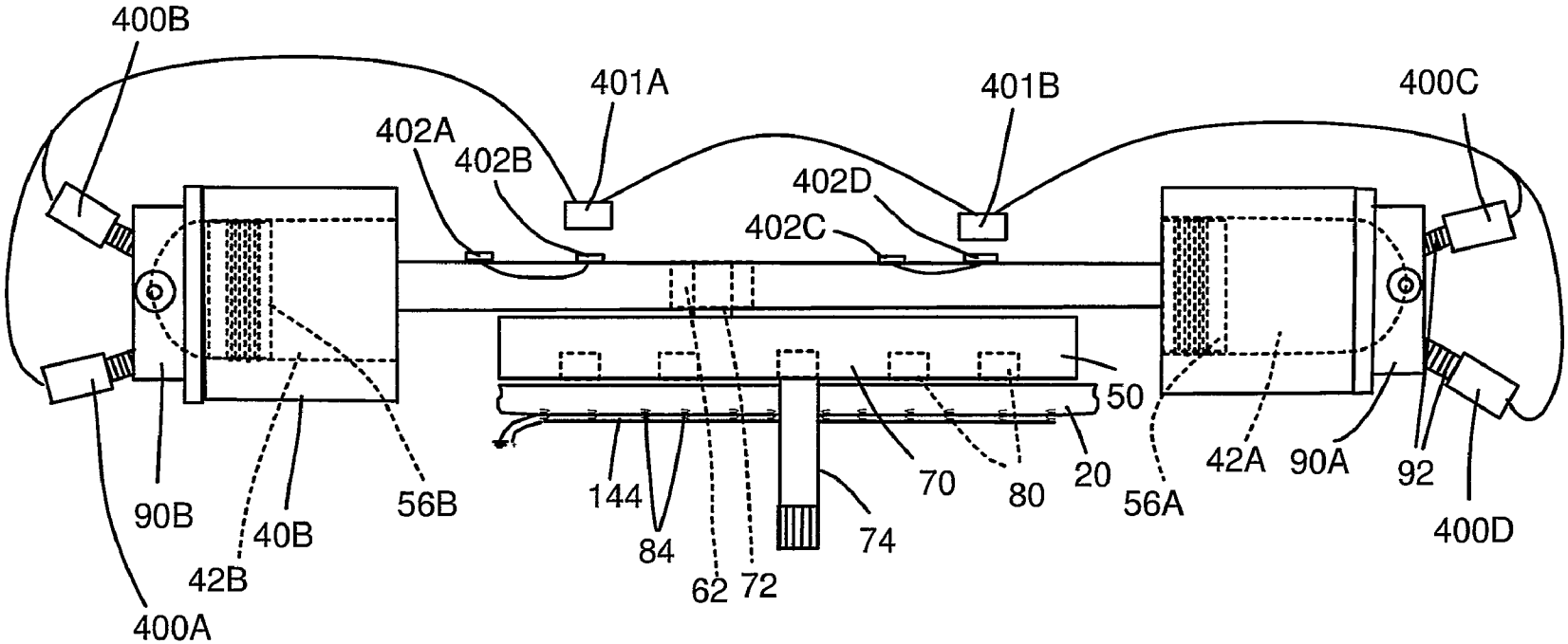
FIG. 37 is a view or another embodiment showing the use of electronic sensors to actuate solenoids as the slide body reciprocates.

For a more precision version in which the valve shaft continually turns, the valve shaft 300 would employ an elliptical groove 304, as shown in FIG. 35 in which the inner and outer banks both follow the centerline axis. This embodiment also includes a parallel secondary shaft 301 with a secondary groove, which has a central section 302 extending parallel to the axis of the shafts 300 and 301. Angled groove sections 303 are located at opposite ends of the central groove section 302. Gears 305A-B are located on opposite ends of the secondary shaft 301, and each of these gears incorporates a clutch bearing that permit the shaft 320 to turn in only one direction. The secondary shaft drives gears 305A-B, which drive gears 306A-B on the valve shaft 101, when gears 305A-B turn. The secondary shaft 301 is driven by a secondary pin 321, which is fixed to the slide body, adjacent the primary drive pin 138 as shown in FIG. 36. Both pins 138 and 321 are mounted on a tower 130, which elevates these pins relative to the upper surface of the central portion of slide body 50 on which the tower 130 is mounted. The secondary shaft only turns when pin 321 enters the angled groove sections 303 at opposite ends. Pin 321 enters angled groove sections 303 as the main pin 138 approaches the portion of the groove 304 where it will reverse direction. As the pin 321 moves along the angled section 303, the secondary shaft 301 rotates and gears 305A-B engage gears 306A-B causing shaft 300 to continue to rotate in the same direction, even if not driven for minute distances by pin 138. The secondary shaft 301 thus causes the shaft 300 to rotate at lest until the primary pin 138 engages the inner bank of the groove 304 in the primary shaft 300. As the valve shaft 300 continues to turn, the secondary shaft is deactivated as the pin 321 enters the straight central groove section 302. Valve shaft 300 will continuously rotate in the same direction to activate valves located at opposite ends in the same manner as discussed with reference to previous embodiments.

For even higher horsepower engines, the gear 87B and the crank and slide bearing 72 as shown in FIGS. 2 and 23 and 24 can be employed. As the slide body 50 reciprocates, the flywheel 70 turns, causing gear 87B to engage fixed gear 87*a* via the crank.

Other improvements could also be added. For example, an adjustable timing mechanism could be added to the valve drive shaft. An assembly shown in FIG. 34 can also be used to operate an electronic timing disc 210 to trigger electronic circuitry which controls relays used to activate solenoids which open and close valves 106 and 108. Another alternative approach to activating the valves would be to use electronic means to follow movement of the slide body, which would active solenoids at the appropriate time for opening and closing the valves. As shown in FIG. 34, valves 106 and 108 can be opened and closed using solenoids 400A-D that are activated by relays which are controlled by electronic circuitry that is triggered either by switches or by sensors 401A and B, which detect transponders 402A-D mounted on the slide body 50. The transponders 401A and B can be mounted on the top cover plate 16.

Figure 38:
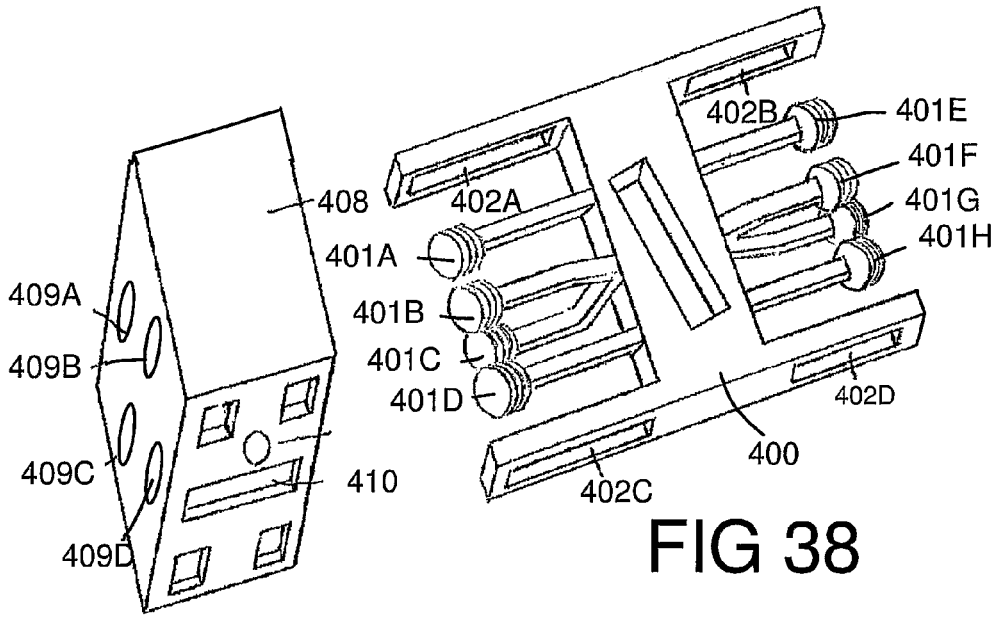
FIG. 38 is a view of a slide body incorporating either pistons, with two pistons mounted one above the other, and showing a configuration for mounting linear gear bearings of the type shown in FIGS. 25-27 in the slide body and cylinder body.
Figure 39:
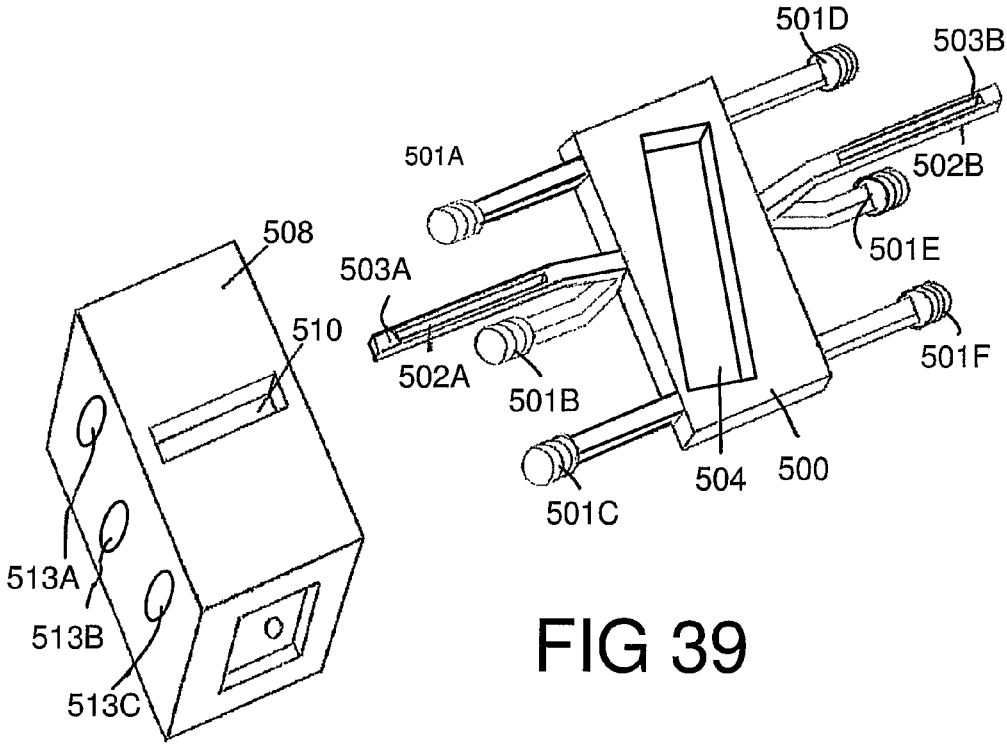
FIG. 39 is a view of another alternate embodiment similar to FIG. 38 in which six pistons are employed and in which linear gear bearings can be mounted above the central piston on each end.

Because of the nature of the slide body, it can be made in a number of configurations. It can have from one piston and arm to multiple pistons on both ends. Multiple pistons can be side by side or the pistons can be placed at different levels. FIGS. 38 and 39 show two different confirmations in which more than two pistons are located on each end of the slide body, and in which pistons are vertically offset. The embodiment of FIG. 38 shows a total of eight pistons 401A-H with four pistons located on opposite ends of the slide body 400. Two central pistons 401B-C and 401F-G are located one above the other on each end. Cylinders 409A-D in cylinder body 408 show the relative positions of the four pistons and cylinders. FIG. 39 shows a six piston version of this engine in which the central pistons 501B and 501E on each end are vertically offset from the flanking pistons 501 A, C, D, F. This vertical offset can also be seen from the positions of the cylinders 513A-C in the cylinder body 508.

The embodiment of FIGS. 38 and 39 also show another way of mounting the linear gear bearing assembly show in FIGS. 25-27. The slide body 400 includes bearing tracks 402A-D located in arms extending along opposite edges of the slide body 400. These bearing tracks 402A-D will be aligned with rectangular openings 410 extending from opposite sides of each cylinder body, although only one opening is shown in FIG. 38. A linear gear raceway 27 and upper and lower included surfaces, having the same configuration as shown in FIG. 27 are mounted in the gear bearing tracks 402A-D, before the ends of slide body 400 are inserted into the cylinder bodies 408. At this point, the gear bearings 64 are inserted through the openings 410, and an outer geared raceway flanked by inclined or tapered surfaces are inserted into openings 410 and secured to the cylinder body. FIG. 39 shows a similar approach in which only a single gear bearing track 502A, B is positioned within corresponding slide body extensions 503A, B located above central pistons 501B and 501E. Linear gear bearing assemblies are mounted in bearing tracks 502A,B and cylinder body openings 510 is the same manner as discussed with reference to FIG. 38.

Figure 40:
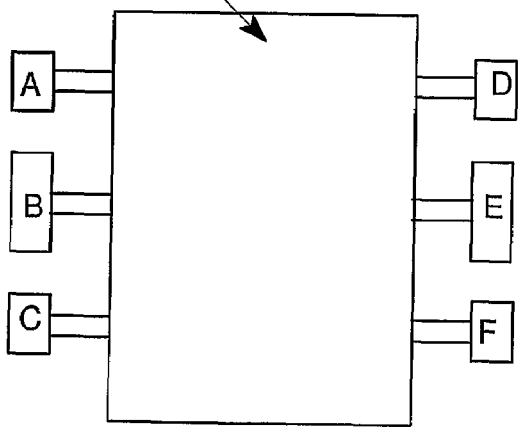
FIG. 40 is a schematic view of a slide body in which a central piston on each end has a larger diameter than flanking pistons.

When more than four pistons in a single slide body assembly other modifications can be employed. If at least six pistons, three located side by side on each side, are employed, a further advantage can be achieved. If the two exterior pistons are fired simultaneously on both ends of the piston subassembly, and if the middle pistons are fired at different times, then the resultant force can always act through the center of mass of the slide body. Thus there will be no tendency of the slide body to become cocked as it moves, and there will be no "bureau drawer" effect. For example, if at the start of the first stroke of a four stroke, two cycle engine in the configuration shown in FIG. 40, pistons A and C are fired simultaneously, the resultant force would be directed through the center of mass. At the start of the second, or return, stroke pistons D and F were to fire, followed by piston B firing at the start of the third stroke with piston E firing at the start of the fourth stroke, all forces would be centrally applied to the slide body. This approach is enhanced if the two centrally mounted pistons B and E have a larger outside diameter, i.e. larger cylinder bore, than the other pistons. The force exerted on larger pistons B and E would be larger than that exerted on individual smaller pistons A,C, D, F. Since two smaller pistons are fired simultaneously, the forces resulting from fuel air mixture combustion would tend to even out, thus further balancing the forces exerted in the engine. For a four stroke, two cycle internal combustion engine, and even number of pistons equal to six or greater, can result in alignment of the resultant force exerted on the piston during each stroke with the center of mass of the piston slide subassembly.

Electricity can be generated by magnets 80 mounted on the flywheel 70, which will move past electrical conductors in the form of coils 84 mounted on a coil plate secured to the exterior face of the bottom plate or lower housing cover 20. As discussed previously the magnets 80 also serve the purpose of adding weight and mass to the flywheel 70, since they are bonded to the exterior of the flywheel. The coils 84 are formed by winding a first wire around iron cores in a first direction and then by winding wire around the same iron cores in a second direction. These coils 84 are then mounted on a mounting plate 82, which is secured to the exterior face of the bottom plate 20. Cavities 130 extend partially into the external face of the bottom plate 20. These cavities receive the coils 84, which are separated from the magnets 80 by a thickness of nonferromagnetic aluminum. The magnets 80, mounted on the flywheel 70, rotate within the internal housing compartment 36 relate to the stationary coils 84 on the coil plate located on the exterior of the housing 10. An electric current is induced in the electric circuit 144 including coils 84 by relative movement of the magnetic field of the magnets 80. The electricity produced in this manner can be used to power external devices, such as the oil pump and the water pump as well as to charge an external battery. This electricity can also be tapped for other uses, which are not directly related to the functioning of this internal combustion engine 1. Although they would not add as much mass to the flywheel, coils could also be mounted on the flywheel instead of using magnets. These flywheel mounted coils, which would be energized by an external electrical supply, would induce a magnetic field, which as it moved relative to the stationary coils 84, thus converting the kinetic mechanical energy of the rotating flywheel to electrical energy. The combination of flywheel mounted magnets, or other means of generating a magnetic field, along with the coils mounted on the exterior of the housing body 10 can also be used as a motor, by generating a variable current in the coils, which will cause the magnets to move and the flywheel to rotate according to well understood physical principles. This arrangement can be used as a starter motor by causing the flywheel 70 to rotate and the piston slide body 50 to reciprocate in a cyclical manner. Alternatively an electric motor of this sort can be used to deliver mechanical power for other purposes by attaching the rotating drive shaft 74, attached to the rotating flywheel 70, to an external implement. The flywheel could also be driven in this manner to provide motive power to a vehicle in which this engine is employed. This engine can therefore comprise a hybrid internal combustion/electrical engine. The same results could also be achieved by employing an externally mounted flywheel.

Figure 41:
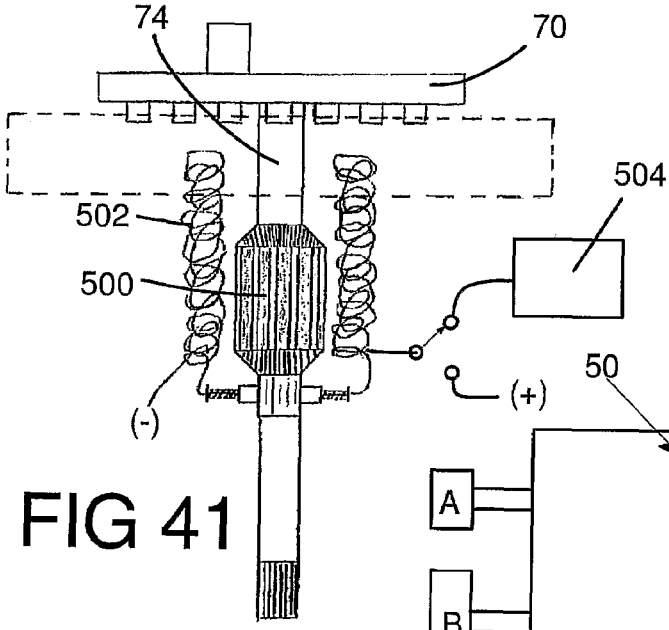
FIG. 41 is a view of an electric motor and an electric generator in which an armature is located on the drive shaft of a flywheel.

FIG. 41 shows another configuration, which can be used in conjunction with or separately from the electrical generation employing the magnets in a rotating flywheel. A rotor or armature 600 can be mounted on the drive shaft 74. A field winding or coils 602 surrounds the armature 600. A brush/commutator subassembly 606 connects the armature 600 to the field coils. A switching element or relay 608 can switch between a charging circuit or a positive pole of a battery. This electrical subassembly can therefore be used either as an electrical generator or as a motor, and in this manner this internal combustion engine could be used as one of the two parts of a hybrid engine in a motor vehicle.

The embodiments depicted herein are merely representative of some of the alternative configurations, which would be apparent to one of ordinary skill in the art, could be employed in accordance with this invention. The representative embodiments depicted herein merely demonstrate the operation of the invention claimed herein.

I claim:

1. An internal combustion engine comprising:

a housing forming a compartment with opposed cylinders at opposite ends of the compartment;

a slide body reciprocal in the housing compartment, the slide body having pistons at opposite ends of the slide body, individual pistons being received within individual cylinders, at least two side by side pistons being located on at least one end of the slide body, wherein the slide body and the pistons comprise a one-piece rigid body, cyclical combustion within the cylinders imparting linear reciprocal motion to the slide body, bearing surfaces between a central portion of the slide body and the housing extending linearly so that the pistons reciprocate linearly within the cylinders;

a rotating disk positioned in the housing compartment, the rotating disk being located adjacent to the slide body and being rotatable about an axis generally perpendicular to linear reciprocal movement of the slide body;

interengaging members on the slide body and rotating disk sufficiently laterally offset from the axis of rotation of the rotating disk to impart rotary motion to the rotating disk as the slide body linearly reciprocates within the housing compartment: and a drive shaft extending through the housing, rotation of the rotating disk being transmitted to the drive shaft so that linear motion of the slide piston is transmitted through the rotating disk to the drive shaft far delivering external power.

2. The internal combustion engine of claim 1 wherein the rotating disk comprises a flywheel.

3. The internal combustion engine of claim 1 wherein the housing compartment is formed by;

an upper cover and a separate lower cover;

side plates attachable to and detachable from the upper cover and the lower cover adjacent opposite edges thereof to form a central housing subassembly having a generally rectangular cross section;

a cylinder body attached to and detachable from one end, of the central housing subassembly, the cylinder body including cylinders receiving the reciprocal pistons, a head attachable to and detachable from the cylinder body and enclosing one end of tbc cylinders;

valves mounted on the head; and valve actuation means;

whereby the internal combustion engine can be assembled and disassembled by respectively attaching and detaching the housing components in surrounding relationship to the reciprocal pistons and the rotary member.

4. The internal combustion engine of claim 3 wherein the reciprocal pistons are fixed to a slide body, the pistons and the slide body moving only linearly, without rotary motion relative to the cylinders.

5. The internal combustion engine of claim 3 wherein coolant is circulated through the side plates and around the cylinder body and head.

6. The internal combustion engine of claim 3 wherein oil is dispersed in an internal compartment bounded by the upper cover, the lower cover and the side plates.

7. The internal combustion engine of claim 1 wherein the rotating disk comprises a flywheel having an axis of rotation substantially perpendicular to the direction in which the pistons move, wherein the flywheel is located in a plane parallel to and adjacent to a central portion of the slide body, the pistons extending in opposite directions from the one-piece member, the flywheel having sufficient angular momentum to dampen reaction forces acting in a direction opposite from the direction of movement of the pistons during sequential strokes due to the expansion of a combustible fuel-air mixture sequentially acting on individual pistons so that the internal combustion engine can be employed in a mobile vehicle.

8. The internal combustion engine of claim 1 wherein the rotating disk includes a first electromagnetic field component, the engine also including a second stationary electromagnetic field component so that electrical energy can be generated by relative rotation of the first electromagnetic field component relative to the second electromagnetic field component, wherein the first electromagnetic field component is coupled to a drive shaft so that the first and second electromagnetic field components can also function as an electric motor.

9. The internal combustion engine of claim 1 comprising a four stroke internal combustion engine wherein the pistons are movable in opposite directions on each successive stroke, and the slide body includes an even number of at least six pistons, with an equal number of pistons on opposite ends of the slide body and with pistons on opposite ends of the slide body facing in opposite directions, combustion occurring in a sequence such that the resultant force acting on pistons during each stroke is parallel to the direction of movement of the piston subassembly such that the piston subassembly does not bind during any stroke due to the absence of any resultant rotary movement of the piston subassembly.

10. The internal combustion engine of claim 9 in which combustion simultaneously energizes at least two pistons on the same end of the slide body at the beginning of at least one stroke.

11. The internal combustion engine of claim 9 wherein the slide body includes six pistons, single pistons centrally positioned on opposite ends of the slide body having a outer diameter larger than the outer diameter of pistons above and below the centrally positioned pistons.

12. An engine including a gear bearing assembly for use between a powered first member reciprocal linearly relative to and adjacent to a stationary second member, the gear bearing assembly comprising:

a plurality of one piece gear bearings, each gear bearing having an upper and a lower conical surface, with a series of gear teeth circumferentially disposed between the upper and lower conical surfaces;

linear gears oppositely disposed on the first and second members, the gear teeth on each gear bearing engaging the linear gears; and inclined surfaces extending above and below the linear gears, the conical surfaces on the gear bearings being juxtaposed to the inclined surfaces as the gear bearings rotate relative to the first and second members;

wherein the gear bearings remain spaced by a substantially constant distance as the first member reciprocates linearly relative to the second member to counteract bureau drawer effects between the first and second members.

13. The engine of claim 12 wherein the gear bearing conical surfaces are spaced from the inclined surfaces by a lubricating material during operation of the gear bearing assembly.

14. An engine including a valve actuation mechanism, the engine comprising:

reciprocal pistons facing in opposite directions and movable linearly in unison, and a valve actuation mechanism shifting lineraly reciprocal valves, the valve actuation mechanism further comprising;

rotating gears including protruding cam surfaces on the gears positioned to open and close the valves as the gears rotate;

a valve cam shaft extending parallel to the linear movement of the pistons and rotating in response to movement of the linearly reciprocal pistons;

a drive gear on the valve cam shaft engaging the rotating gears to cause the protruding cam surface to open and close the valves as the valve cam shaft rotates during cyclical movement of the pistons.

15. The engine of claim 14 wherein the valve cam shaft includes a peripheral groove engagable with a protrusion extending transversely relative to the direction in which the pistons move, the protrusion moving along the groove during cyclical movement of the pistons.

16. The engine of claim 14 wherein the cam surfaces are located on interior faces of the rotating gears.

17. The engine of claim 14 wherein a secondary shaft extends parallel to the valve cam shaft, each shaft including a peripheral groove, the peripheral groove in the valve cam shaft extending around the valve cam shaft and the peripheral groove in the secondary shaft extending only partially around the secondary shaft, with two side by side protrusions extending transverse to the pistons engaging respective peripheral grooves, the secondary shaft engaging the valve cam shaft as the direction of relative movement of the protrusions relative to the valve cam shaft changes resulting in constant rotation of the valve cam shaft.

18. The engine of claim 14 wherein a bevel gear is mounted on the valve cam shaft, the bevel gear engaging a drive bevel gear rotating in response to linear movement of the pistons.

19. The engine of claim 14 wherein opposed bevel gears are spaced apart on the valve cam shaft, the opposed bevel gears engaging a drive bevel gear positioned thereberween and rotating in opposite directions in response to linear movement of the piston, each opposed bevel gear being mounted on clutch bearings so that the drive bevel gear can impart rotation to the valve cam shaft in only a single direction.

20. The engine of claim 14 wherein each rotating gear can be separately removed from the valve cam shaft for repair, alignment or replacement.

21. An internal combustion engine comprising:

a housing forming a compartment with opposed cylinders at opposite ends of the compartment;

a slide body reciprocal in the housing compartment, the slide body having pistons at opposite ends of the slide body, individual pistons being received within individual cylinders, cyclical combustion within the cylinders imparting linear reciprocal motion to the slide body;

a rotating member positioned in the housing compartment, the rotating member being located adjacent to the slide body and being rotatable about an axis generally perpendicular to linear reciprocal movement of the slide body;

interengaging members on the slide body and rotating member sufficiently laterally offset from the axis of rotation of the rotating member to impart rotary motion to the rotating member as the slide body linearly reciprocates within the housing compartment; and a drive shaft extending through the housing, rotation of the rotating member being transmitted to the drive shaft so that linear motion of the slide piston is transmitted through the rotating member to the drive shaft for delivering external power;

wherein the engine includes a first electromagnetic field component rotatable in response to linear movement of the slide body, the engine also including a second stationary electromagnetic field component so that electrical energy can be generated by relative rotation of the first electromagnetic field component relative to the second electromagnetic field component, wherein the first electromagnetic field component is coupled to a drive shaft so that the first and second electromagnetic field components can also function as an electric motor.

* * * * *